US009637970B1

(12) United States Patent
Rendon, Jr. et al.

(10) Patent No.: US 9,637,970 B1
(45) Date of Patent: May 2, 2017

(54) DOUBLE BREAKOUT SLIDING DOOR SYSTEM

(71) Applicant: Landert Motoren AG, Bülach (CH)

(72) Inventors: Humberto Rendon, Jr., San Antonio, TX (US); Jaime Alonzo Ramirez, San Antonio, TX (US); David Samuel Woodring, San Antonio, TX (US)

(73) Assignee: LANDERT MOTOREN AG, Bulach (CH)

( * ) Notice: Subject to any disclaimer, the term of this patent is extended or adjusted under 35 U.S.C. 154(b) by 0 days.

(21) Appl. No.: 14/919,713

(22) Filed: Oct. 21, 2015

(51) Int. Cl.

| | |
|---|---|
| ***E05D 15/58*** | (2006.01) |
| ***E06B 3/50*** | (2006.01) |
| ***E05D 15/48*** | (2006.01) |
| ***E05D 15/54*** | (2006.01) |
| ***E05D 15/56*** | (2006.01) |
| ***E06B 3/26*** | (2006.01) |

(52) U.S. Cl.
CPC ..... *E06B 3/509* (2013.01); *E05D 15/48* (2013.01); *E05D 15/54* (2013.01); *E05D 15/56* (2013.01); *E06B 3/26* (2013.01); *E06B 3/5054* (2013.01); *E05D 2015/485* (2013.01)

(58) Field of Classification Search
CPC ..... E05B 65/1033; E05B 65/10; E05Y 2201/214; E05Y 2900/132; E05Y 2800/746; E05Y 2800/25; E05D 15/48; E05D 15/58; E05D 2015/485; E05D 2015/482; B61D 19/023; B61D 19/008; E06B 3/5072; E06B 3/50
See application file for complete search history.

(56) References Cited

U.S. PATENT DOCUMENTS

| | | | | | |
|---|---|---|---|---|---|
| 704,887 | A * | 7/1902 | Low | E05F 17/00 | 160/181 |
| 3,266,189 | A * | 8/1966 | Eby | E06B 3/4654 | 49/152 |
| 3,318,047 | A * | 5/1967 | Carson | E06B 3/50 | 49/141 |
| 3,354,581 | A * | 11/1967 | Kessner | E06B 3/50 | 49/141 |
| 3,491,483 | A * | 1/1970 | Miller | E05D 15/0604 | 49/141 |
| 3,834,081 | A * | 9/1974 | Catlett | E05F 15/646 | 49/118 |
| 4,305,227 | A * | 12/1981 | Georgelin | E05D 15/48 | 49/141 |
| 4,438,594 | A * | 3/1984 | Bunzl | E05D 15/58 | 49/125 |
| 4,503,637 | A * | 3/1985 | Parente | E05D 15/06 | 49/118 |

(Continued)

*Primary Examiner* — Justin Rephann
(74) *Attorney, Agent, or Firm* — Shane V. Cortesi

(57) ABSTRACT

The present invention relates to a double breakout sliding door system for use in retail and other buildings. The system includes left and right doors that are configured to slide open and closed and also breakout in two directions (outward and inward) when a force is exerted on the doors in order to, for example, allow customers and employees to exit a building in the event of a fire and to prevent damage to the doors in the event that a user pushes on them when they are closed. The system also includes a leveling system configured to keep the doors level when they breakout and a ball detent mechanism to alert the user to the proper position of the doors.

20 Claims, 26 Drawing Sheets

(56) References Cited

U.S. PATENT DOCUMENTS 4,534,395 A * 8/1985 Carroll ..... E05D 15/264 160/118
4,924,628 A * 5/1990 Ruby ..... E06B 3/4609 49/380
5,242,005 A * 9/1993 Borgardt ..... E05D 15/264 160/118
5,392,834 A * 2/1995 Borgardt ..... E06B 3/481 160/118
5,486,026 A * 1/1996 Borgardt ..... E05B 15/0205 292/71
5,581,944 A * 12/1996 Kornbrekke ..... E05D 11/0081 49/27
5,749,172 A * 5/1998 Isopahkala ..... E05D 15/0604 49/124
5,762,123 A * 6/1998 Kuyama ..... E05D 15/264 160/118
5,832,980 A * 11/1998 Cianciolo ..... E05D 15/58 160/197
6,058,665 A * 5/2000 Halvorson, Jr. ..... E05D 15/48 49/159
6,170,195 B1 * 1/2001 Lim ..... E05D 15/58 49/141
6,422,287 B1 * 7/2002 Wilke ..... E05D 15/58 160/195
6,526,695 B1 * 3/2003 Nguyen ..... E05D 7/1005 49/141
6,618,994 B1 * 9/2003 Nussbaum ..... E05D 15/58 292/171
7,451,802 B2 * 11/2008 Cianciolo ..... E05D 15/08 160/210
7,458,410 B1 * 12/2008 Bronner ..... E05D 15/0656 160/197
7,950,439 B2 * 5/2011 Anderson ..... E05D 15/58 160/195
8,096,342 B2 * 1/2012 Scruggs ..... E05D 15/0626 160/211
8,443,549 B2 * 5/2013 Salvietti ..... E05D 15/48 49/118
8,756,865 B2 * 6/2014 Nicholson ..... E05D 15/48 49/142
2004/0025455 A1 * 2/2004 Nubel ..... E05D 15/063 52/204.51
2005/0028946 A1 * 2/2005 Weishar ..... E05D 15/54 160/214
2006/0150512 A1 * 7/2006 Heithe ..... E05B 65/10 49/141
2012/0073205 A1 * 3/2012 Hamaker ..... E06B 3/5072 49/163
2012/0255230 A1 * 10/2012 Smith ..... E05D 15/48 49/257

* cited by examiner

DOUBLE BREAKOUT SLIDING DOOR SYSTEM

BACKGROUND

Technical Field

The present invention relates to automatic sliding door systems.

Background of the Invention

Retail stores in the United States commonly use automatic sliding doors, which consist of a right, door and a left door that slide along a sliding plane from a sliding closed position to a sliding open position when, for example, a motion sensor detects a shopper or employee. Fire code regulations generally require that such doors break open outward to allow egress of shoppers or employees from the store in the event of a fire. Such sliding doors typically only break open outward—not inward. While such systems are generally designed for the safety of pedestrian traffic, the movement of large or heavily loaded equipment often puts the door at risk of being damaged especially when moving such equipment into the store. In addition, in such prior systems, when a door breaks open outward, the bottom corner of the door that meets the other door when the doors are closed (also referred to as the nose) drops on the ground. This can be problematic in that the doors, which are heavy, must be raised to reset the normal sliding operation of the doors.

Thus, there is a need for sliding door systems that break outward and inward. There is also a need for sliding door systems that break outward and inward and can be quickly reset to the normal sliding operation of the doors.

BRIEF SUMMARY

The present disclosure provides a double breakout sliding door system as described herein.

More particularly, the system may include: a rectangular door system frame comprising a system frame front side, a system frame rear side, a system frame thickness extending from the system frame front side to the system frame rear side, a system frame top, a system frame bottom, a system frame height extending from the system frame top to the system frame bottom, a system frame left side, a system frame right side, and a system frame width extending from the system frame left side to the system frame right side, the rectangular door system frame defining a system frame opening; a left door comprising a left, door front side, a left door rear side, a left door thickness extending from the left door front side to the left door rear side, a left door left side, a left door right side, a left door width extending from the left door left side to the left door right side, the left door width perpendicular to the left door thickness, a left door top, a left door bottom, and a left door height extending from the left door top to the left door bottom, the left door height perpendicular to the left door width and the left door thickness; a right door comprising a right door front side, a right door rear side, a right door thickness extending from the right door front side to the right door rear side, a right door left side, a right door right side, a right door width extending from the right door left side to the right door right side, the right door width perpendicular to the right door thickness, a right door top, a right door bottom, and a right door height extending from the right door top to the right door bottom, the right door height perpendicular to the right door width and the right door thickness; a top left panel located above the left door, the top left panel connected to the left door and comprising a top left panel left side, a top left panel right side, a top left panel top, a top left panel bottom located below the system frame top, a top left panel height extending from the top left panel top to the top left panel bottom, a top left panel front side, a top left panel rear side, and a top left panel thickness extending from the top left panel front side to the top left panel rear side, the top left panel height perpendicular to the left door thickness, the top left panel thickness and the top left panel width; a top right panel located above the right door, the top right panel connected to the right door and comprising a top right, panel left side, a top right panel right side, a top right panel width extending from the top right panel left side to the top right panel right side, a top right panel top, a top right panel bottom located below the system frame top, a top right panel height extending from the top right panel top to the top right panel bottom, a top right panel front side, a top right panel rear side, and a top right panel thickness extending from the top right panel front side to the top right panel rear side, the top right, panel height perpendicular to the right door thickness, the top right panel thickness and the top right panel width; a motor; a left rod having a left rod top pivotally attached to the top left panel by a left pivot pin forming a left pivot pin axis and a left rod bottom attached to the left door left side, the left rod extending in a general downward direction from the top left panel at least partially through the left door; and a right rod having a right rod top pivotally attached to the top right panel by a right pivot pin forming a right pivot pin axis and a right rod bottom attached to the right door right side, the right rod extending in a general downward direction from the top right panel at least partially through the right door, wherein the motor is configured to slide the left door and right door in a sliding plane parallel to the system frame width from a sliding open position in which the left and right doors are apart and do not close the system frame opening to a sliding closed position in which the left and right doors meet to close the system frame opening, wherein the top left panel is configured to slide with the left door from the sliding open position to the sliding closed position, wherein the top right panel is configured to slide with the right door from the sliding open position to the sliding closed position, wherein the left door is configured to rotate about the left rod from the sliding plane to a left door front, open position when a force is exerted on the left door rear side perpendicular to the left door rear side when the left door is in the sliding plane, wherein the left door is configured to rotate about the left rod from the sliding plane to a left door rear open position when a force is exerted on the left door front side perpendicular to the left door front side when the left door is in the sliding plane, wherein the left door right side is in front of the rectangular door system frame and in front of the left door left side in the left door front open position and wherein the left door right side is to the rear of the rectangular door system frame and to the rear of the left door left side in the left door rear open position, and further wherein the right door is configured to rotate about the right rod from the sliding plane to a right door front open position when a force is exerted on the right door rear side perpendicular to the right door rear side when the right door is in the sliding plane, wherein the right door is configured to rotate about the right rod from the sliding plane to a right door rear open position when a force is exerted on the right door front side perpendicular to the right door front side when the right door is in the sliding plane, wherein the right door left side is in front of the rectangular door system frame and in front of the right door right side in the right door front open position and wherein the right door left side is to the rear of the rectangular door system frame and to the rear of the right door right side in the right door rear open position.

Optionally, the bottom of the left door right side is configured to remain at substantially the same height relative to the rectangular door system frame when the left door rotates about the left rod from the sliding plane to the left door front open position and to the left door rear open position and further wherein the bottom of the left side of the right door is configured to remain at substantially the same height relative to the rectangular door system frame when the right, door rotates about the right, rod from the sliding plane to the right door front open position and to the right door rear open position. Optionally, the system further comprises a left door top latch extending from the left door top, wherein the system further comprises a top left panel bottom latch extending from the top left panel bottom, wherein the left door top latch and the top left panel bottom latch are configured to mate when the left door is in the sliding plane and further wherein the left door top latch and the top left panel bottom latch are not configured to mate when the left door is in the left door front open position and the left door rear open position. Optionally, the top left panel bottom latch is configured to support the left door when the left door is in the sliding plane and further wherein the top left panel bottom latch is not configured to support the left door when the left door is in the left door front open position and the left door rear open position. Optionally, the left door top latch is adjacent to the left door right side, wherein the left door top latch comprises: i) a left door latch base comprising a left door latch base bottom attached to the left door top and a left door latch base top; ii) a left door latch flange located above the left door latch base and comprising a left door latch flange bottom, a left door latch flange top and a left door latch flange height extending from the left door latch flange bottom to the left door latch flange top; and iii) a left door latch slot located between the left door latch base and the left door latch flange and comprising a left door latch slot, height extending from the left door latch base top to the left door latch flange bottom, wherein the top left panel bottom latch is adjacent to the top left panel right side, wherein the top left panel bottom latch comprises: i) a top left panel latch base comprising a top left panel latch base top attached to the top left panel bottom and a top left panel latch base bottom; ii) a top left panel latch flange located below the top left panel latch base and comprising a top left panel latch flange bottom, a top left panel latch flange top and a top left panel latch flange height extending from the top left panel latch flange bottom to the top left panel latch flange top; and iii) a top left panel latch slot located between the top left panel latch base and the top left panel latch flange and comprising a top left panel latch slot height extending from the top left panel latch base bottom to the top left panel latch flange top, wherein the top left panel latch slot height is greater than the left door latch flange height, wherein the left door latch slot height is greater than the top left panel latch flange height, wherein the left door latch flange is configured to be positioned in the top left panel latch slot when the left door is in the sliding plane, and further wherein the top left panel latch flange is configured to be positioned in the left door latch slot, when the left door is in the sliding plane.

Optionally, the left door and the top left panel further comprises a ball detent comprising a ball, a recess configured to receive the ball, and a spring connected to the ball and configured to urge the ball toward the recess, and further wherein the ball is configured to move into the recess when the top left panel latch flange is positioned in the left door latch slot and the left door latch flange is positioned in the top left panel latch slot. Optionally, the left rod bottom is configured to be the sole point of attachment of the left door to the top left panel when the left door is in the left door front open position and the left door rear open position. Optionally, the left pivot pin axis and the right pivot pin axis are perpendicular to the system frame front side and the system frame rear side. Optionally, the top left panel further comprises a left adjustment fastener configured to engage the left rod and cause the left rod to pivot along the left pivot pin axis and further wherein the top right panel further comprises a right adjustment fastener configured to engage the right rod and cause the right rod to pivot along the right pivot, pin axis. Optionally, pivoting of the left rod along the left pivot, pin axis is configured to cause the bottom of the left door right side to move vertically relative to the top left panel and further wherein pivoting of the right rod along the right pivot axis is configured to cause the bottom of the right door left side to move vertically relative to the top right panel. Optionally, the left door comprises a left door frame comprising an interior and further wherein the left rod is located within the left door frame interior and further wherein the right door comprises a right door frame comprising an interior and further wherein the right rod is located within the right door frame interior. Optionally, the left rod bottom is hollow and surrounds a threaded shank of a left threaded bolt comprising a head and the threaded shank, wherein the left rod is fixed to the threaded shank of the left threaded bolt, wherein the left door further comprises a left door bracket located between the head of the left threaded bolt and the left rod bottom, wherein the left door bracket is attached to the left door frame, wherein the left door bracket is configured to rotate about the left rod and the left threaded bolt while the left rod and the left threaded bolt remain stationary as the left door moves from the sliding plane to the left door front open position and the left door rear open position and further wherein the bottom of the right rod is hollow and surrounds a threaded shank of a right threaded bolt comprising a head and the threaded shank, wherein the right rod is fixed to the threaded shank of the right threaded bolt, wherein the right door further comprises a right door bracket located between the head of the right threaded bolt and the bottom of the right rod, wherein the right, door bracket is attached to the left door frame, wherein the right door bracket is configured to rotate about the right rod and the right threaded bolt while the right rod and the right threaded bolt remain stationary as the right door moves from the sliding plane to the right door front open position and the right door rear open position. Optionally, the system, further comprises a left fastener fixing the left rod to the threaded shank of the left threaded bolt and a right fastener fixing the right rod to the threaded shank of the right threaded bolt. Optionally, the left door frame forms a perimeter around a plurality of left door glazing blocks and further wherein the right door frame forms a perimeter around a plurality of right door glazing blocks. Optionally, the plurality of left door glazing blocks are located between the left door frame and a left door glazing panel and further wherein the plurality of right door glazing blocks are located between the right door frame and a right door glazing panel. Optionally, the system further comprises a left door panel configured to remain fixed relative to the rectangular door system, frame when the left door moves from the sliding closed position to the sliding open position, the left door panel located to the left of the left door when the left door is in the sliding closed position, wherein the left door is configured to slide to the rear of the left door panel when the left door slides from the sliding closed position to the sliding open position, wherein the left door panel is configured to move with the left door when the left door moves from the sliding plane to the left door front open position, and further wherein the left door panel is configured to remain fixed relative to the rectangular door system frame when the left door moves from the sliding plane to the left door rear open position. Optionally, the system further comprises a left track located above the top left panel and further wherein the system comprises a left wheel connected to the top left panel and located in the left track and further wherein the left wheel is configured to move along the left track when the top left panel and left door slide from the sliding closed position to the sliding open position and further wherein the system further comprises a right, track located above the top right panel and further wherein the system comprises a right wheel connected to the top right panel and located in the right track and further wherein the right wheel is configured to move along the right track when the top right panel and right door slide from the sliding closed position to the sliding open position. Optionally, the motor is configured to move the left wheel along the left track and the right wheel along the right track. Optionally, the system further comprises a sensor in electronic communication with the motor and configured to cause the left door, the top left panel, the right door and the top right panel to move from the sliding plane to the sliding open position when the sensor detects an object in front of the left door and the right door. Optionally, moving the left door from the sliding plane to the left door front open position and the left door rear open position is configured to disable the motor.

BRIEF DESCRIPTION OF THE DRAWINGS

in FIG. 1, the left and right doors are level relative to the top left panel, the top right panel and the ground and in the sliding open position.

in FIG. 2, the left and right doors are level relative to the top left panel, the top right panel and the ground and, as compared to FIG. 1, the left door and the right door have moved along the sliding plane from the sliding open position to the sliding closed position.

in FIG. 3, the left and right doors are level relative to the top left panel, the top right panel and the ground and in the sliding open position.

in FIG. 4, the left and right doors are level relative to the top left panel, the top right panel and the ground and in the rear open position.

in FIG. 5, the left and right doors are level relative to the top left panel, the top right, panel and the ground and in the front open position.

in FIG. 7, the rear portion of the left side of the frame of the left door is removed and a portion of the rear of the top left panel is removed.

in FIG. 8A, the upper lock of the door is locked and the ball of the detent is located in the recess.

in FIG. 10 the left door is level relative to the top left panel and the ground and in the sliding plane.

in FIG. 11 the left door is level relative to the top left panel and the ground and between the sliding plane and the left door front open position.

in FIG. 12 the left door is level relative to the top left panel and the ground and between the sliding plane and the left door front open position.

in FIG. 13 the left door is level relative to the top left panel and the ground and in the left door front open position.

in FIG. 14 the left door is level relative to the top left panel and the ground and in the left door rear open position.

in FIG. 15, a portion of the rear of the left side of the frame of the left door is removed and a portion of the rear of the top left panel is removed.

in FIG. 16, a portion of the rear of the left side of the frame of the left door is removed and a portion of the rear of the top left panel is removed, the left door is not level relative to the top left panel and the ground and a line and arrows show how the left rod may be pivoted by adjusting a left adjustment fastener.

in FIG. 17, the ball of the detent is located in the recess.

in FIG. 18, the ball of the detent, is not located in the recess.

in FIG. 19, the left door is located between the sliding plane and the left door front open position.

in FIG. 20, the rear portion of the left side of the frame of the left door is removed and a portion of the rear of the top left panel is removed.

in FIG. 21, the left side of the frame of the left door is removed in order to better show the left rod and left door bracket.

in FIG. 22, the left side of the frame of the left door is partially removed in order to better show the left rod and left door bracket.

in FIG. 23, the left side of the frame of the left door is partially removed in order to better show the left rod and left door bracket.

in FIG. 23A, the left door bracket has rotated slightly relative to the left rod as compared to FIG. 22A.

in FIG. 24, the left side of the frame of the left door is partially removed in order to better show the left rod and left door bracket.

in FIG. 24A, the left door bracket has rotated relative to the left rod as compared to FIG. 22A and FIG. 23A.

DETAILED DESCRIPTION

Figure 1:
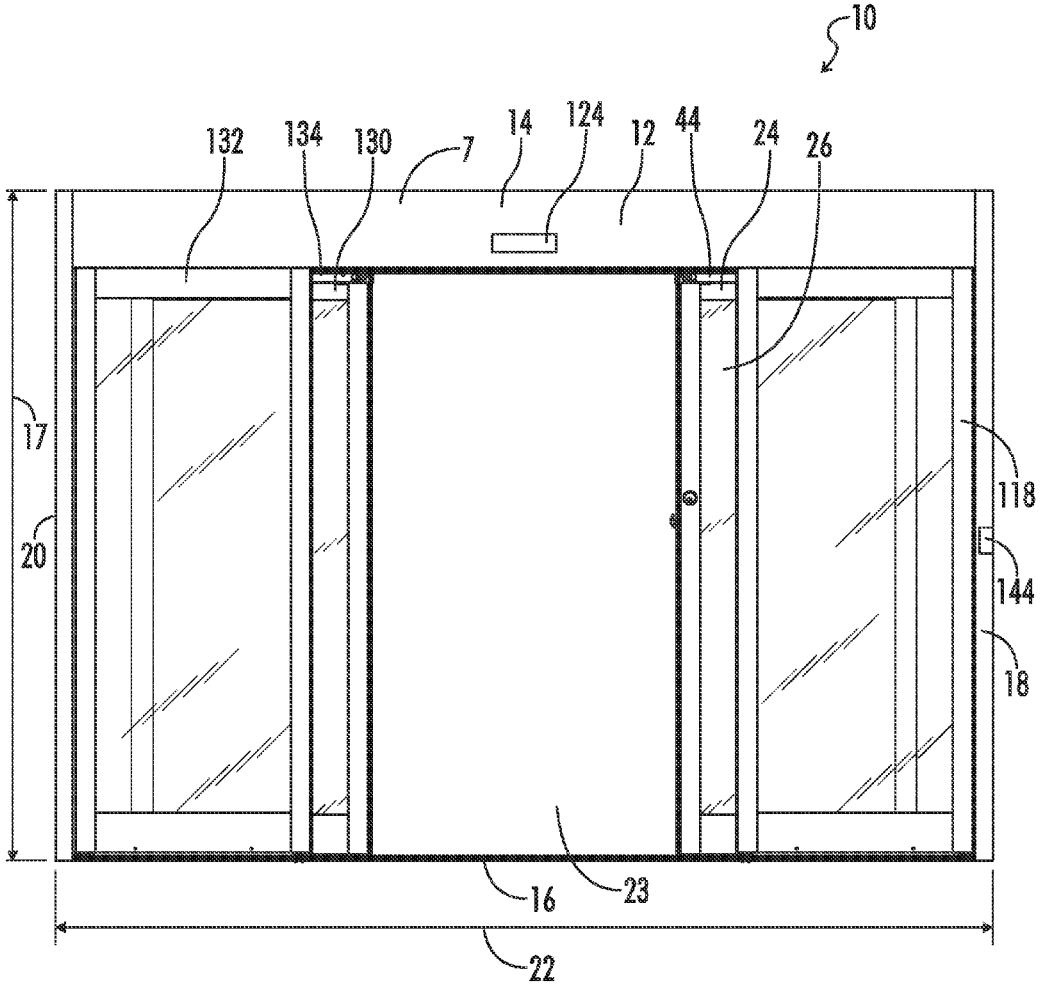
FIG. 1 illustrates a front, elevation view of a double breakout sliding door system of one embodiment of the present invention.

With reference to FIGS. 1-29, the present invention provides a double breakout sliding system door designated by the numeral 10. In the drawings, not all reference numbers are included in each drawing for the sake of clarity.

Referring further to FIGS. 1-29, in some embodiments, the double breakout sliding door system 10 includes a rectangular door system frame 12 comprising a system frame front side 7, a system frame rear side 8, a system frame thickness extending from the system frame front side 7 to the system frame rear side 8, a system frame top 14, a system frame bottom 16, a system frame height 17 extending from the system frame top 14 to the system frame bottom 16, a system frame left side 18, a system, frame right side 20, and a system frame width 22 extending from the system frame left side 18 to the system frame right side 20, the rectangular door system frame 12 defining a system frame opening 23. It will be appreciated that the system frame bottom 16 may be the ground, as shown in FIGS. 1-5, for example. (The terminology "door system frame" is also referred to as merely a "door frame" in the art; the extra word "system" is used herein to differentiate the door system frame/door frame 12 from the left door frame 102—i.e., the frame that forms part of the left door 24—which is later described herein).

The double breakout sliding door system 10 further includes a left door 24 comprising a left door front side 26, a left door rear side 28, a left door thickness 30 extending from the left door front side 26 to the left door rear side 28, a left door left side 32, a left door right side 34, a left door width 36 extending from the left door left side 32 to the left door right side 34, the left door width 36 perpendicular to the left door thickness 30, a left door top 38, a left door bottom 40, and a left door height 42 extending from the left door top 38 to the left door bottom 40, the left door height 42 perpendicular to the left door width 36 and the left door thickness 30, the left door width 36 parallel to the system frame width 22, when the left door 24 is in the sliding plane (as described below).

Figure 2:
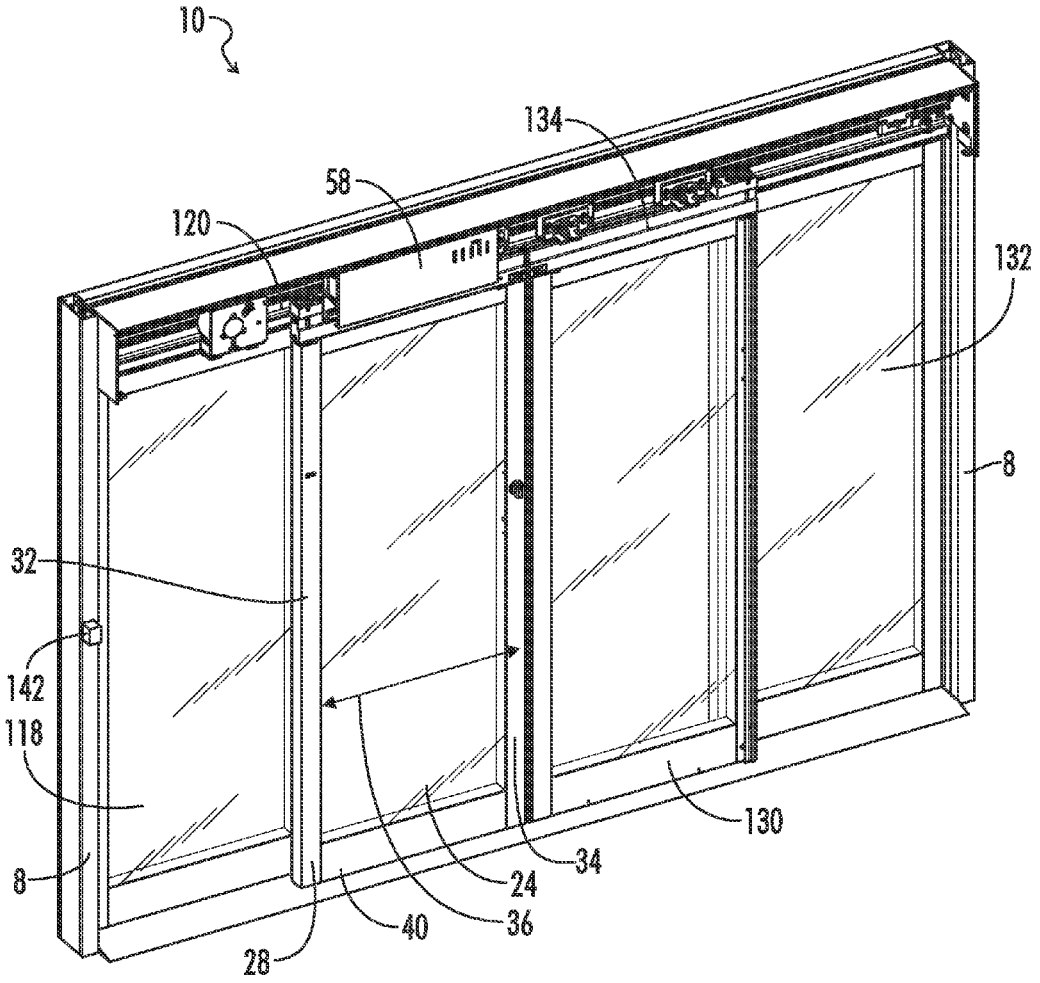
FIG. 2 illustrates a rear, perspective view of the double breakout sliding door system of FIG. 1.

In the present application, it will be understood that the adjectives "left" and "right" are used to label components such as the doors, panels, and rods by viewing the double breakout sliding door system 10 from the rear, as shown in FIG. 2.

The double breakout sliding door system 10 optionally further includes a right door 130. The right door 130 is optionally a mirror image of the left door 24, except that for the locks 126 and 128, for example, as later described. Given the duplicity of the components and design, the parts of the right door 130 are not numbered in the drawings.

The double breakout sliding door system 10 optionally further includes a top left panel 44 (known in the art as a "carrier") located above the left door 24, the top left panel 44 connected to the left door 24 and comprising a top left panel left side 45, a top left panel right side 47, a top left, panel width 49 extending from the top left panel left side 45 to the top left panel right side 47, a top left panel top 46, a top left panel bottom 48 located below the system frame top 14 and the system frame opening 23, a top left panel height 50 extending from the top left panel top 46 to the top left panel bottom 48, a top left panel front side 52, a top left panel rear side 54, and a top left panel 56 thickness extending from the top left panel front side 52 to the top left panel rear side 54, the top left panel height 50 parallel to the left door height 42 when the left door 24 is in the sliding plane and perpendicular to the left door thickness 30 and the top left panel thickness 56 and the top left panel width 49. The top left panel 44 may be comprised of two or more discrete parts (e.g., a block 136 mounted on top of a top left panel frame piece 138, which may be for example comprised of extruded aluminum) and may have a variable height 50, as best seen in FIGS. 6-8, 10, 10A, 11-16, 19, 19A, 20, 20A, 21, 21A, 22, 22A, 23, 23A, 24, 24A, and 26-29.

The double breakout sliding door system 10 optionally further includes a top right panel 134. The top right panel 134 is optionally a mirror image of the top left panel 44, except for the top lock 128, for example, as later described. Given the duplicity of the components and design, the parts of the top right panel 134 are not numbered in the drawings.

The double breakout sliding door system 10 optionally further includes a motor 58.

Figure 20:
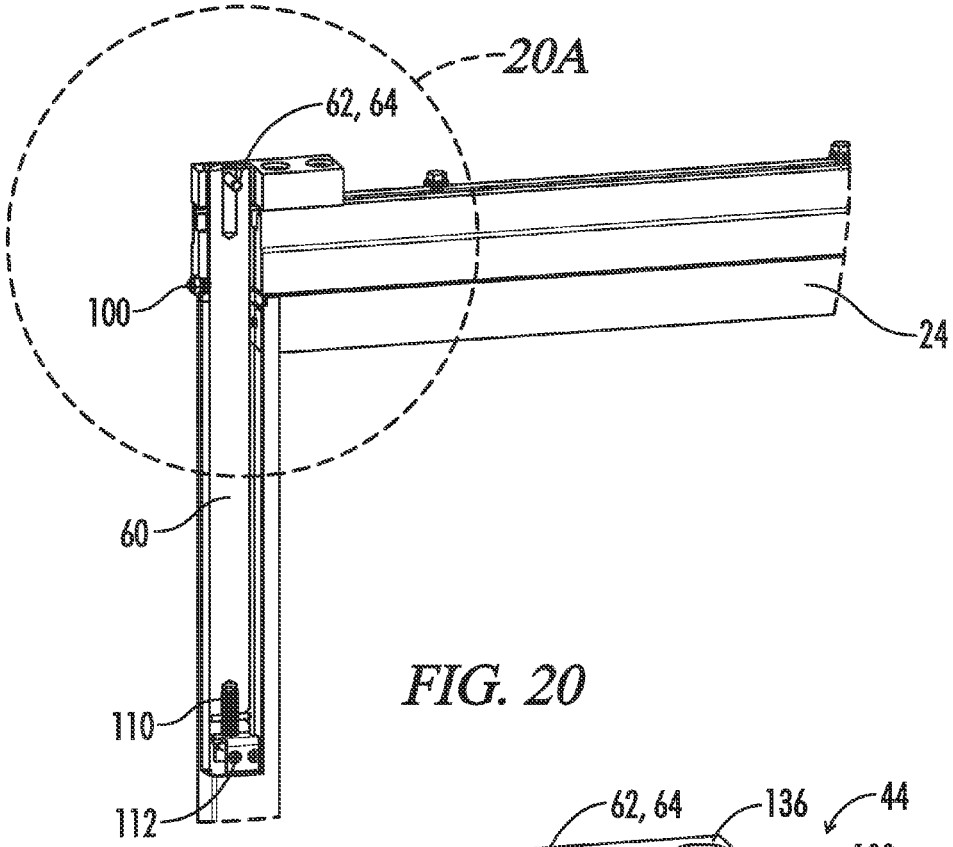
FIG. 20 illustrates a rear, perspective view of the left door and top left panel of the double breakout sliding door system of FIG. 1 and the left door is level relative to the top left panel and the ground and in the sliding plane.
Figure 20A:
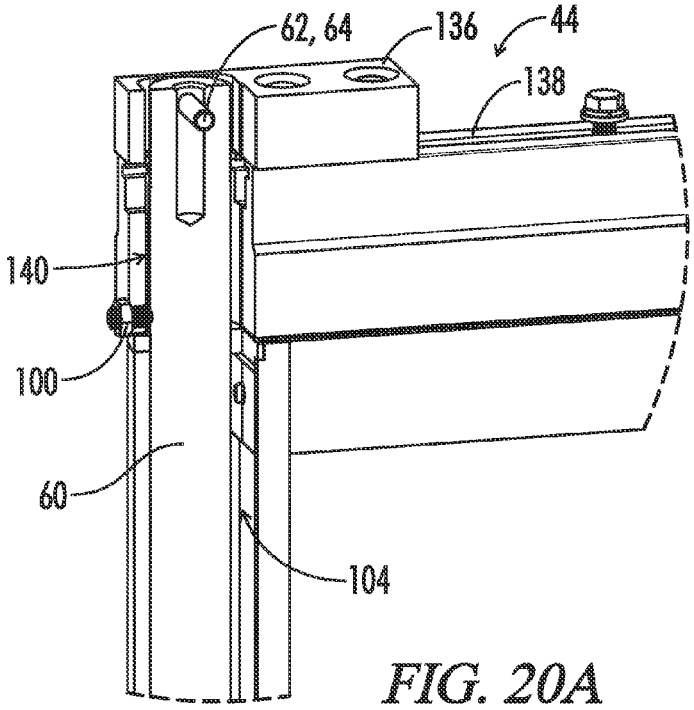
FIG. 20A illustrates a rear, perspective, close-up view of the circled area labelled 20A in FIG. 20.
Figure 21:
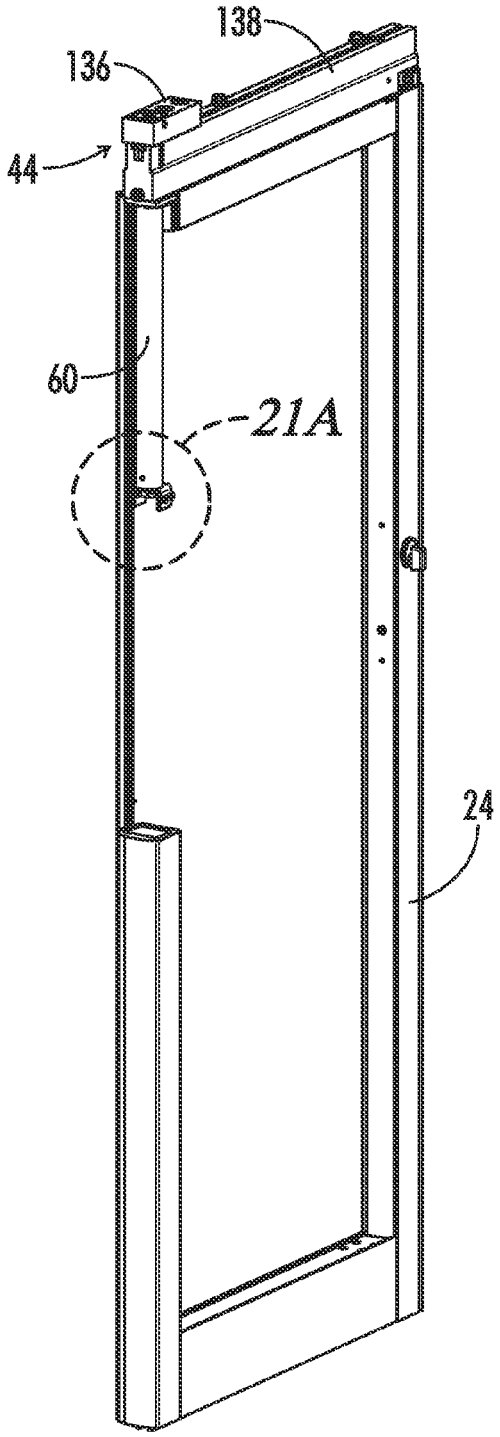
FIG. 21 illustrates a rear, perspective view of the left door and the top left panel of the double breakout sliding door system of FIG. 1 and the left door is level relative to the top left panel and the ground and in the sliding plane.
Figure 21A:
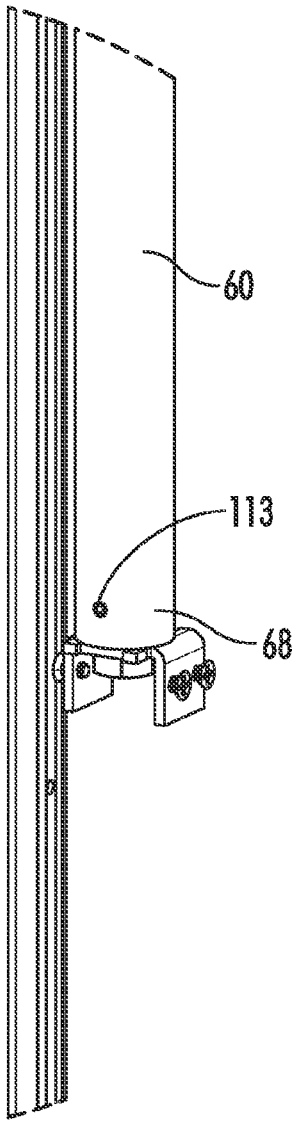
FIG. 21A illustrates a rear, perspective, close-up view of the circled area labelled 21A in FIG. 21.
Figure 22:
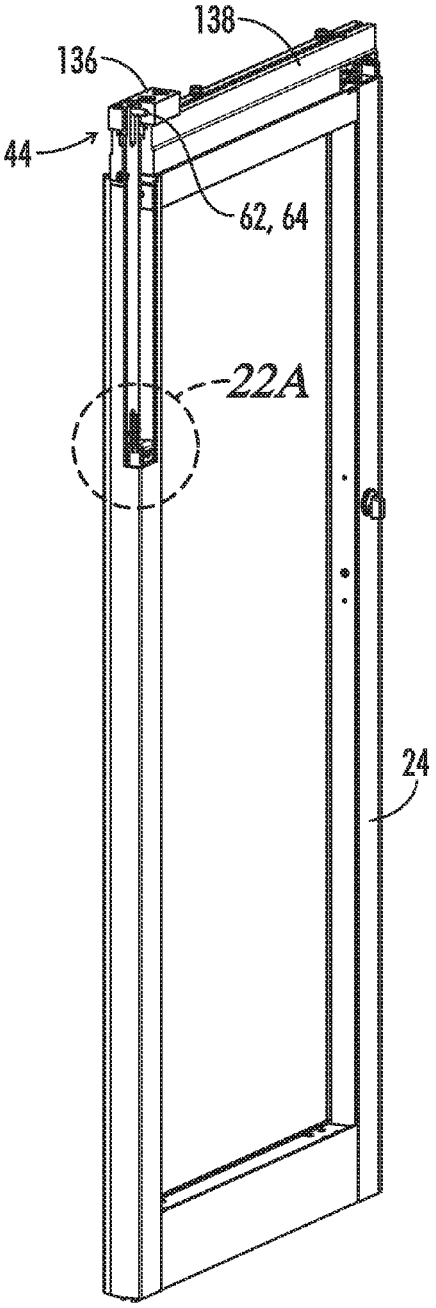
FIG. 22 illustrates a rear, perspective view of the left door and the top left panel of the double breakout sliding door system of FIG. 1 and the left door is level relative to the top left panel and the ground and in the sliding plane.
Figure 22A:
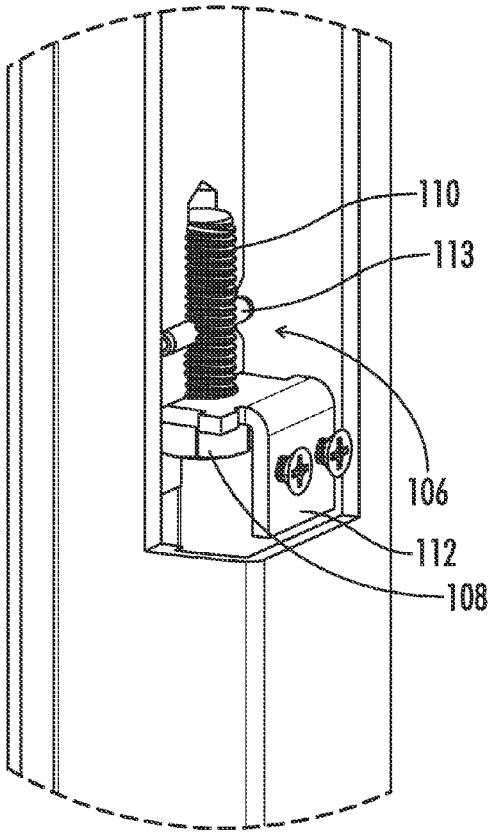
FIG. 22A illustrates a rear, perspective, close-up view of the circled area labelled 22A in FIG. 22.
Figure 23:
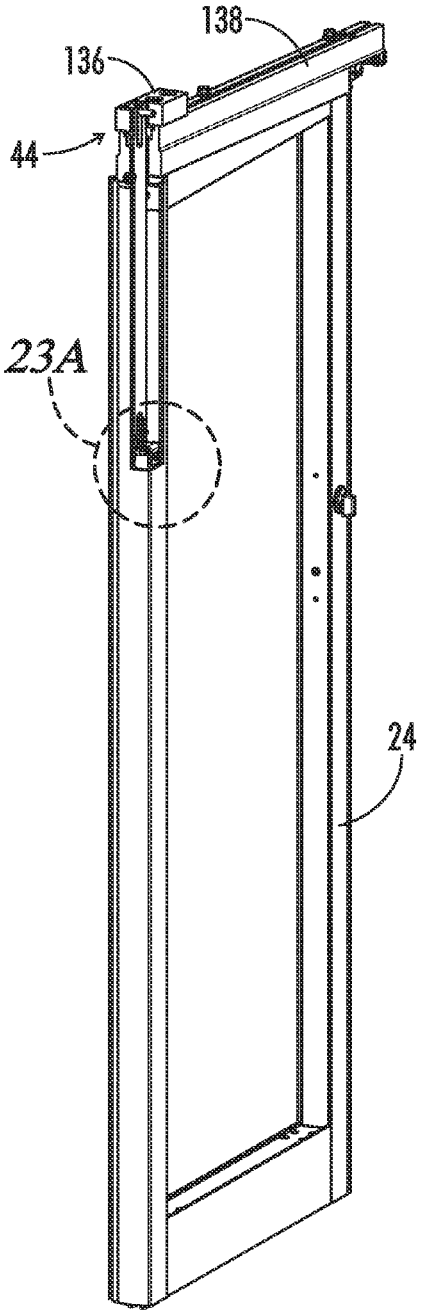
FIG. 23 illustrates a rear, perspective view of the left door and the top left panel of the double breakout sliding door system of FIG. 1 and the left door is level relative to the top left panel and the ground and between the sliding plane and the left door front open position.
Figure 23A:
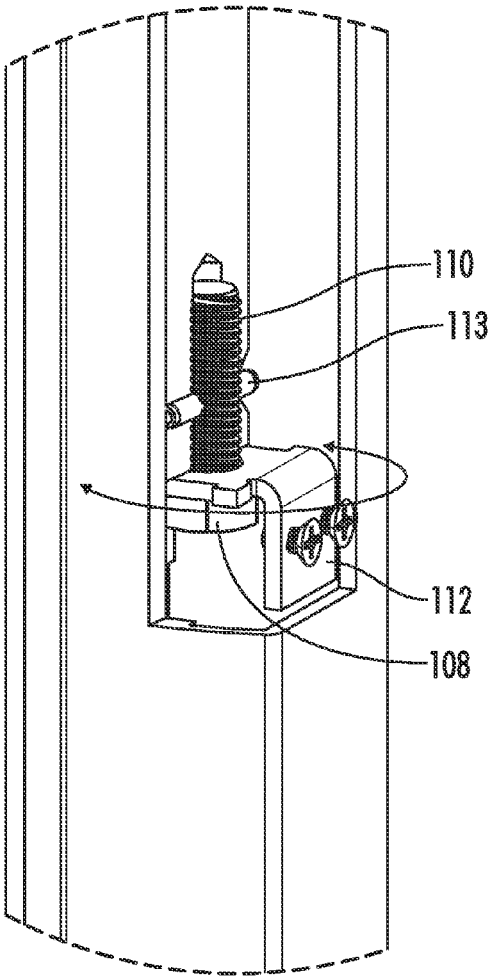
FIG. 23A illustrates a rear, perspective, close-up view of the circled area labelled 23A in FIG. 23.

The double breakout sliding door system 10 optionally further includes a left rod 60 having a left rod top 66 pivotally attached to the top left panel 44 by a left pivot pin 62 forming a left pivot pin axis 64 and a left rod bottom 68 attached to the left door left side 32, the left rod 60 extending in a general downward direction from the top left panel 44 at least partially through the left door 24. The left rod 60 optionally is generally cylindrical in shape. It will be understood that the left pivot pin 62 and left pivot pin axis 64 do not have to be at the very top end of the left rod 60 and that the attachment point of the left rod 60 to the left door 24 does not have to be at the very bottom end of the left rod 60—rather the left pivot pin 62 and left pivot pin axis 64 are attached to the left rod top 66 (i.e., attached adjacent to the top end of the left rod 60) and the attachment point of the left rod 60 to the left door 24 is at the left rod bottom 68 (i.e., adjacent to the bottom end of the left rod 60). As best seen in FIG. 20A, the left rod 60 passes through a slot 140 that extends from the top left panel 44 at least partially through the left door 24.

The double breakout sliding door system 10 optionally further includes a right rod (not shown). The right rod is optionally a mirror image of the left rod 60. Given the duplicity of the components and design, the right rod parts are not numbered in the drawings.

Figure 3:
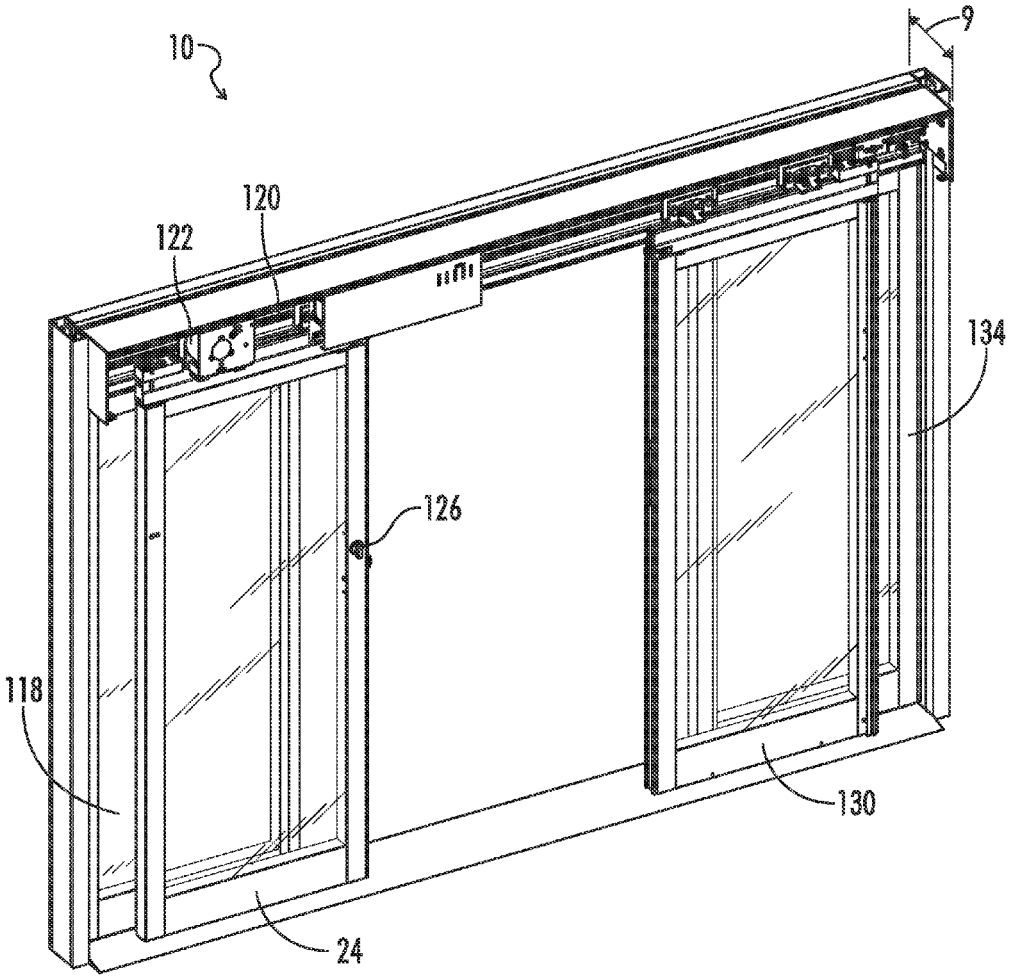
FIG. 3 illustrates a rear, perspective view of the double breakout sliding door system of FIG. 1.

Optionally, the motor 58 is configured to slide the left door 24 and right door 130, i.e., move the left door 24 and right door 130 horizontally along a sliding plane parallel to the system frame width 22, from a sliding open position in which the left door 24 and right door 130 are apart and do not close the system frame opening 23 (as illustrated in FIGS. 1 and 3) to a sliding closed position in which the left door 24 and right door 130 meet to close the system frame opening 23 (as illustrated in FIG. 2). It will be appreciated that when the left door 24 is in the sliding plane, the left door width 36 is parallel to the system frame width 22.

Optionally, the top left panel 44 is configured to slide with the left door 24 from the sliding open position to the sliding closed position and the top right panel 134 is configured to slide with the right door 130 from the sliding open position to the sliding closed position.

Figure 4:
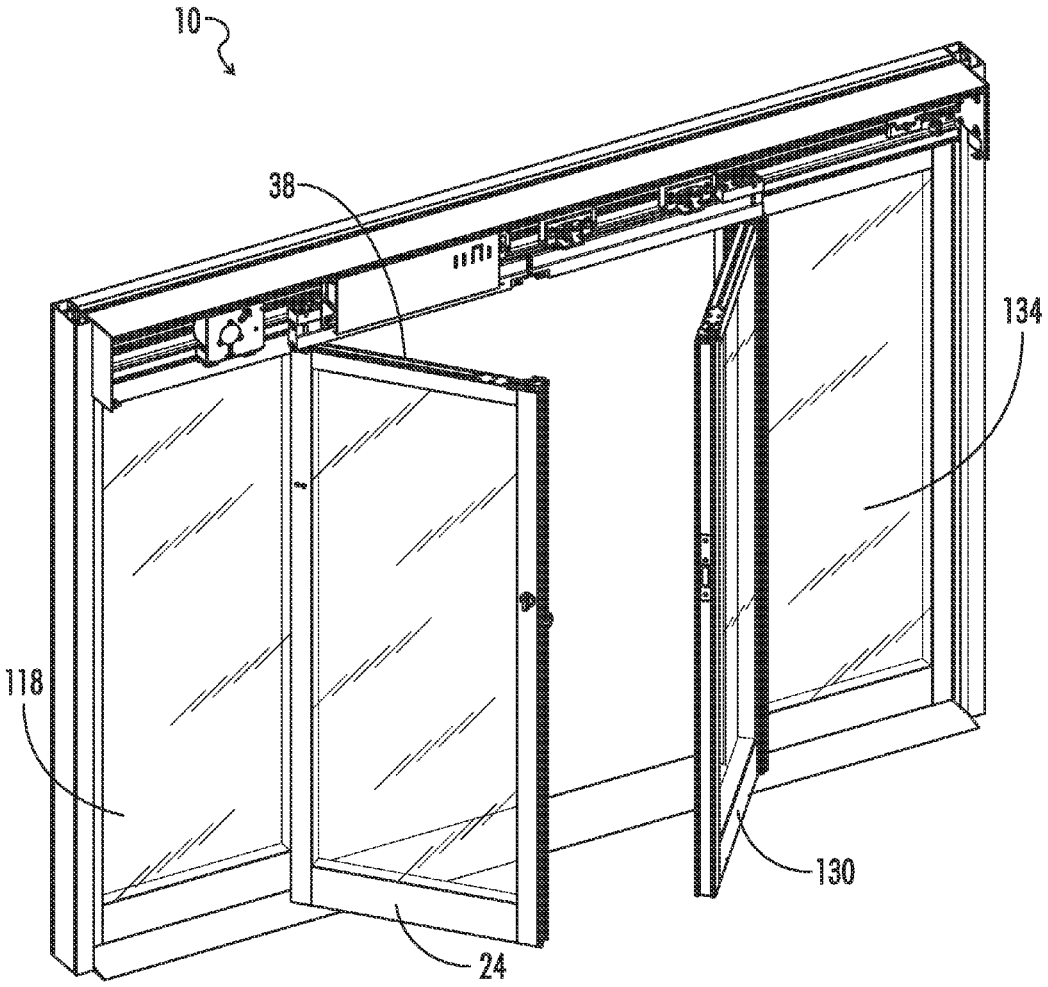
FIG. 4 illustrates a rear, perspective view of the double breakout sliding door system of FIG. 1.
Figure 5:
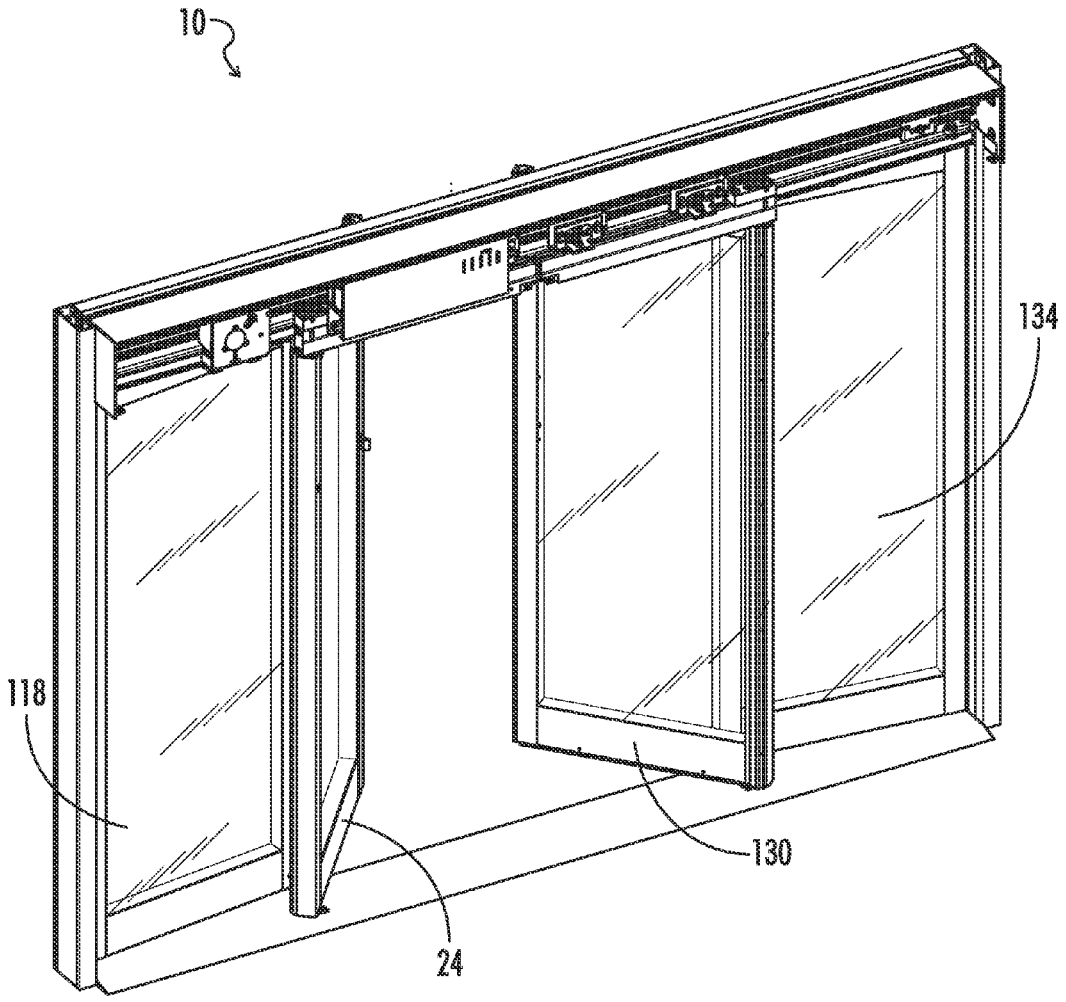
FIG. 5 illustrates a rear, perspective view of the double breakout sliding door system of FIG. 1.
Figure 6:
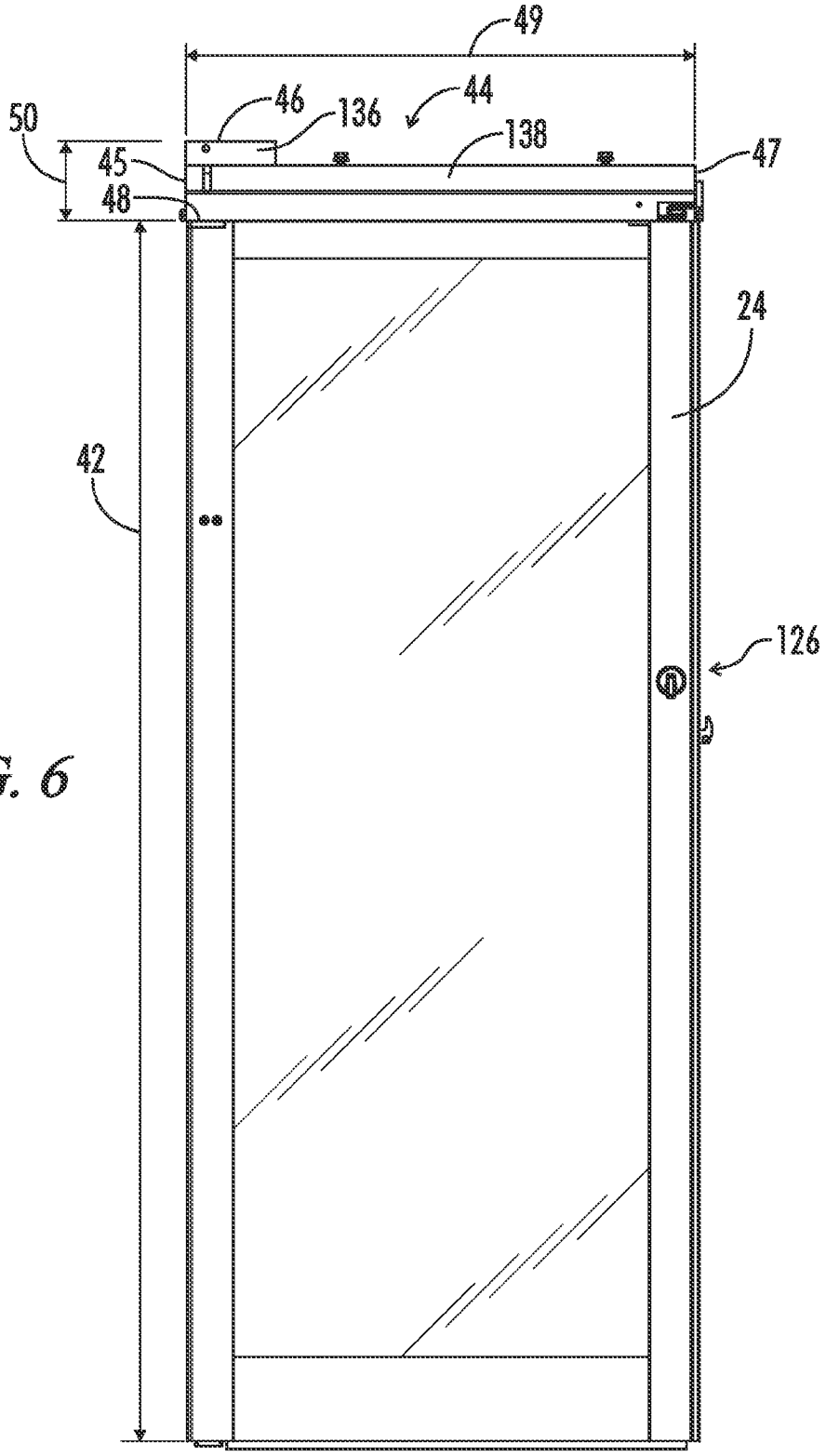
FIG. 6 illustrates a rear, elevation view of the left door and the top left panel of the double breakout sliding door system of FIG. 1 and the left door is level relative to the top left panel and the ground and in the sliding plane.
Figure 7:
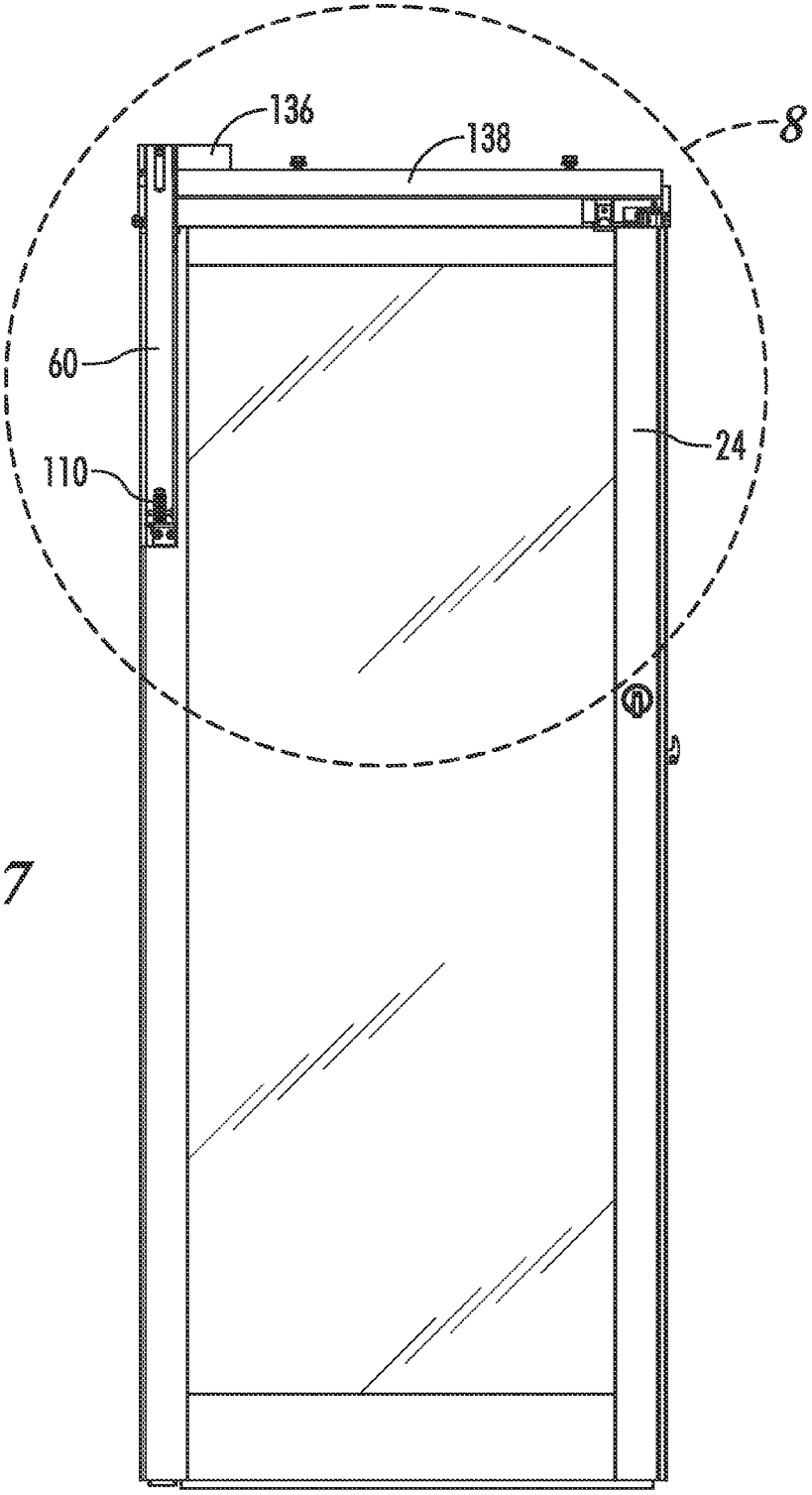
FIG. 7 illustrates a rear, elevation view of the left door and the top left panel of FIG. 6.
Figure 8:
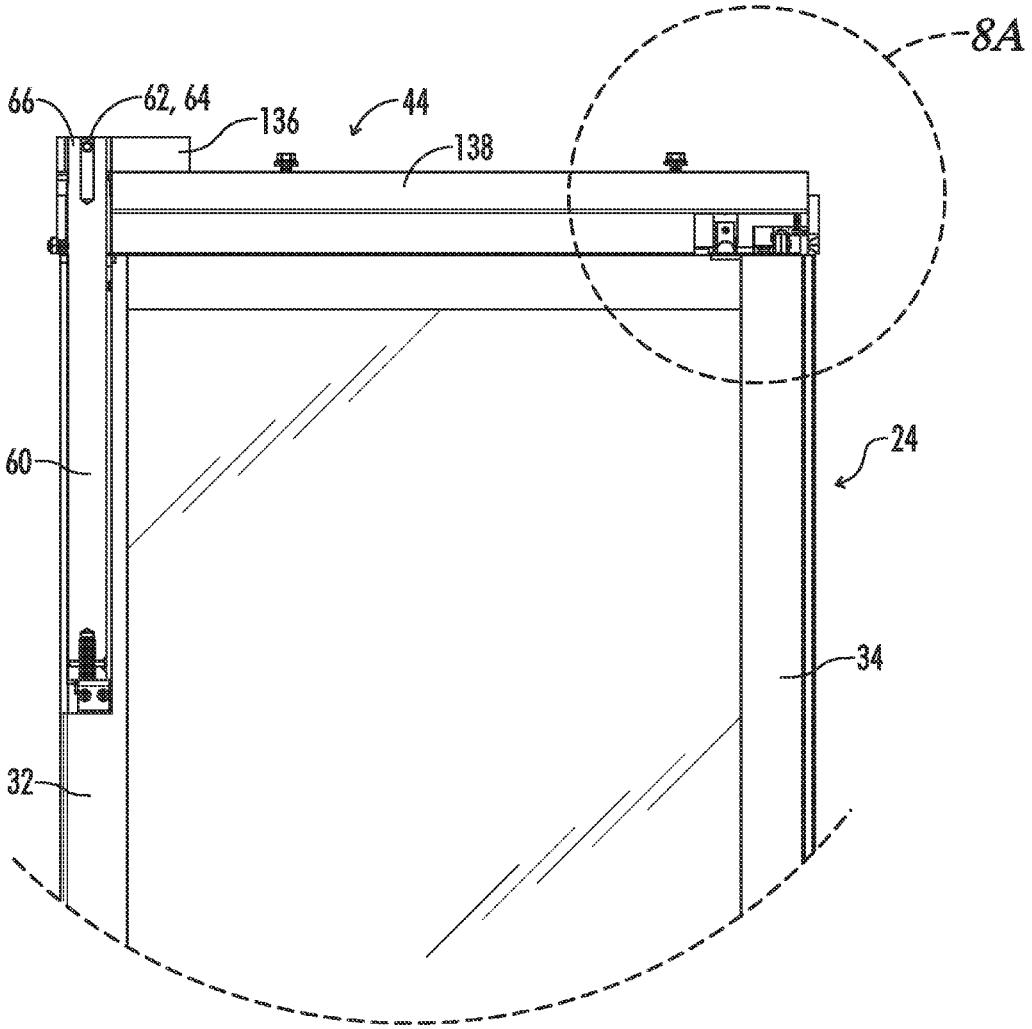
FIG. 8 illustrates a rear, elevation close-up view of the circled area labelled 8 in FIG. 7.
Figure 8A:
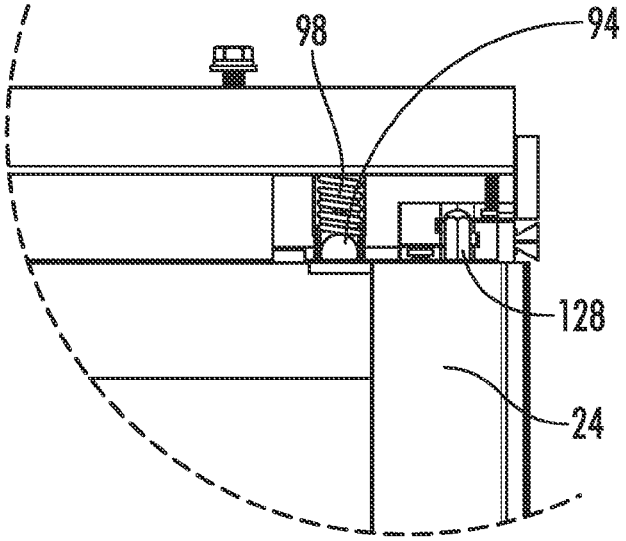
FIG. 8A illustrates a rear, elevation close-up view of the circled area labelled 8A in FIG. 8.
Figure 8B:
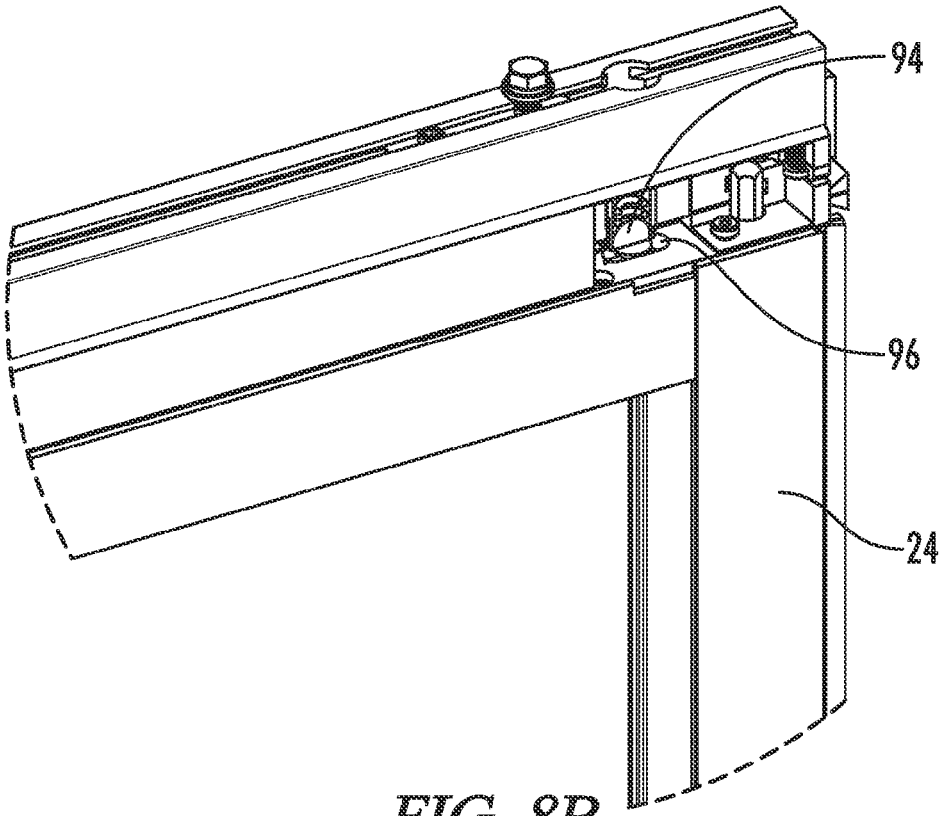
FIG. 8B illustrates a rear, perspective close-up view of the circled area labelled 8A in FIG. 8.
Figure 13:
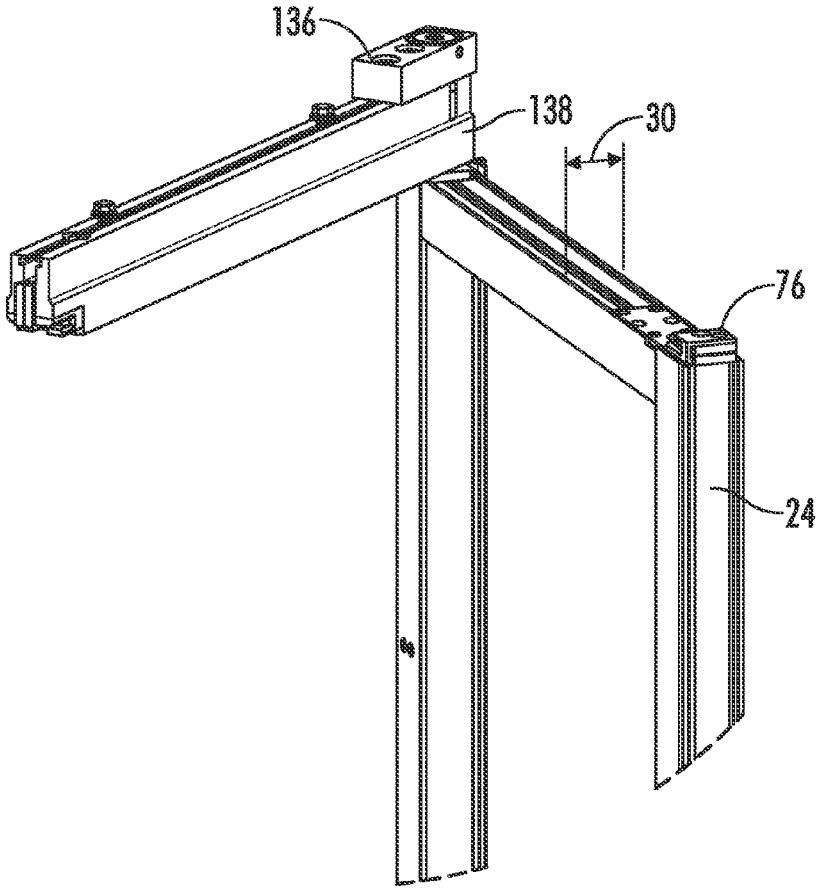
FIG. 13 illustrates a front, perspective view of the left door and the top left panel of the double breakout sliding door system of FIG. 1.
Figure 14:
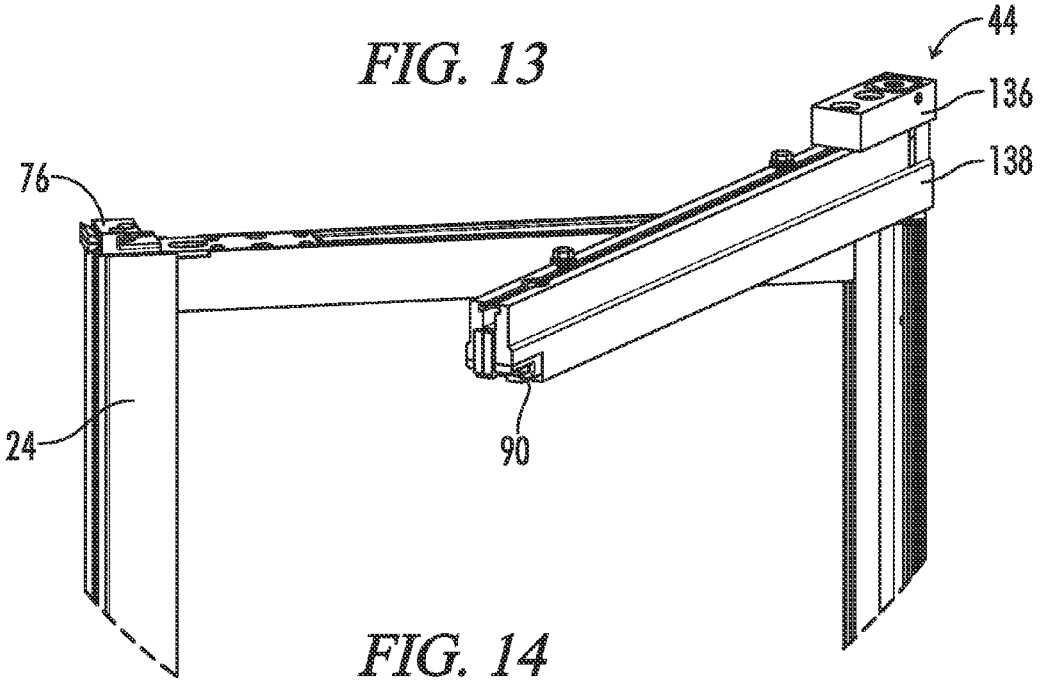
FIG. 14 illustrates a front, perspective view of the left door and the top left panel of the double breakout sliding door system of FIG. 1.
Figure 15:
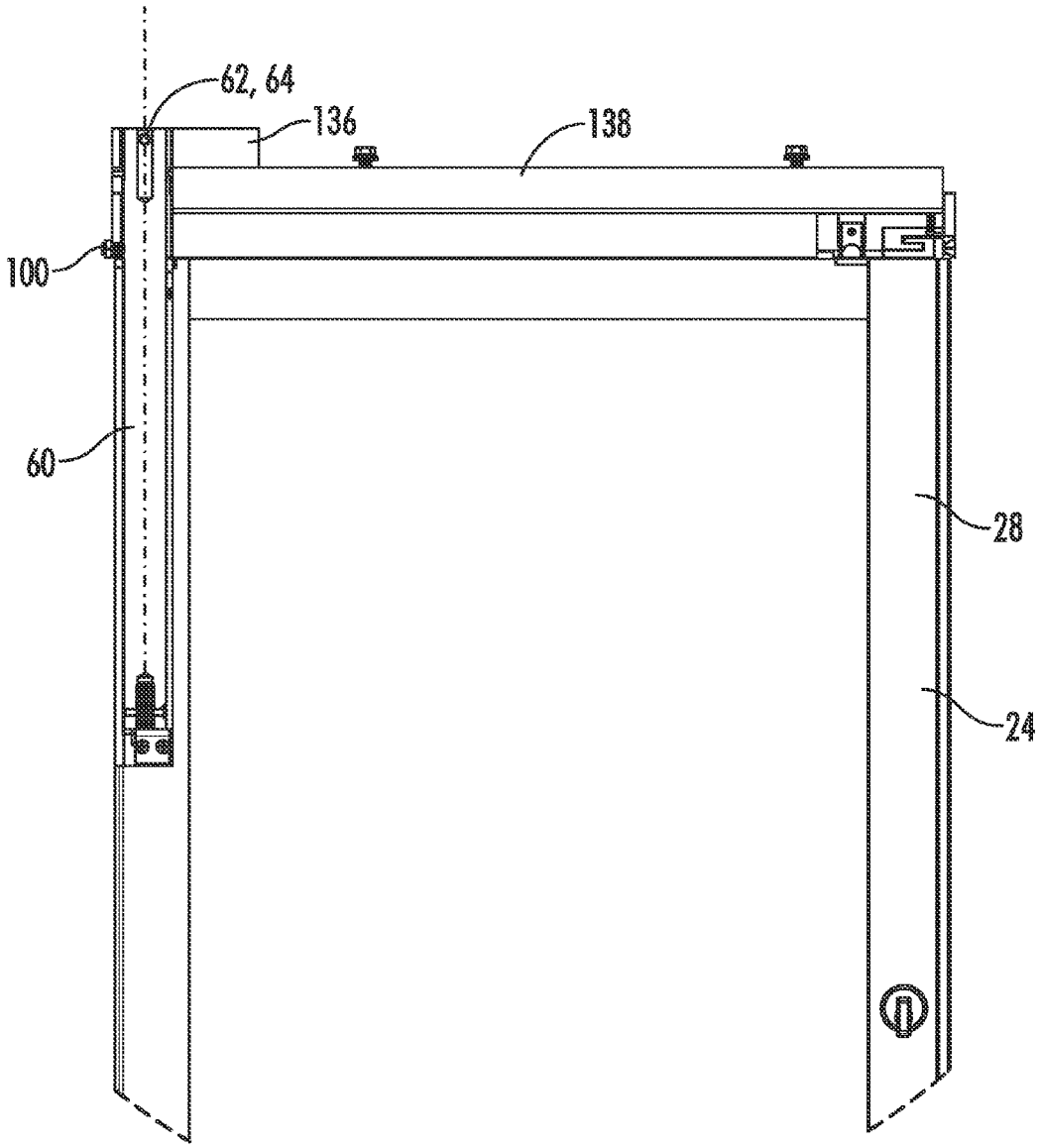
FIG. 15 illustrates a rear, elevation view of the left door and the top left panel of the double breakout sliding door system of FIG. 1 and the left door is level relative to the top left panel and the ground and in the sliding plane.
Figure 24:
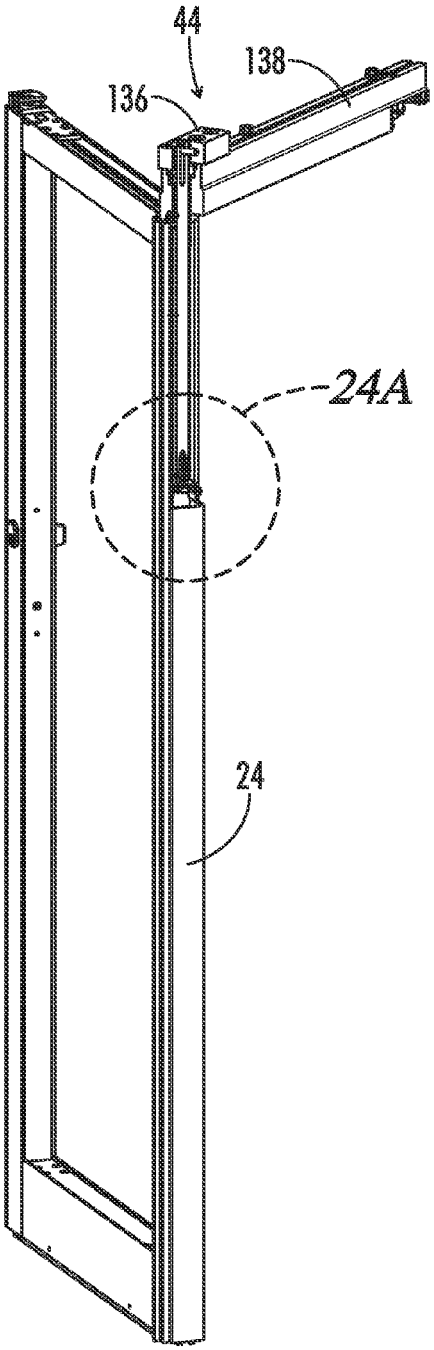
FIG. 24 illustrates a side, perspective view of the left door and the top left panel of the double breakout sliding door system of FIG. 1 and the left door is level relative to the top left panel and the ground and in the left door front open position.
Figure 24A:
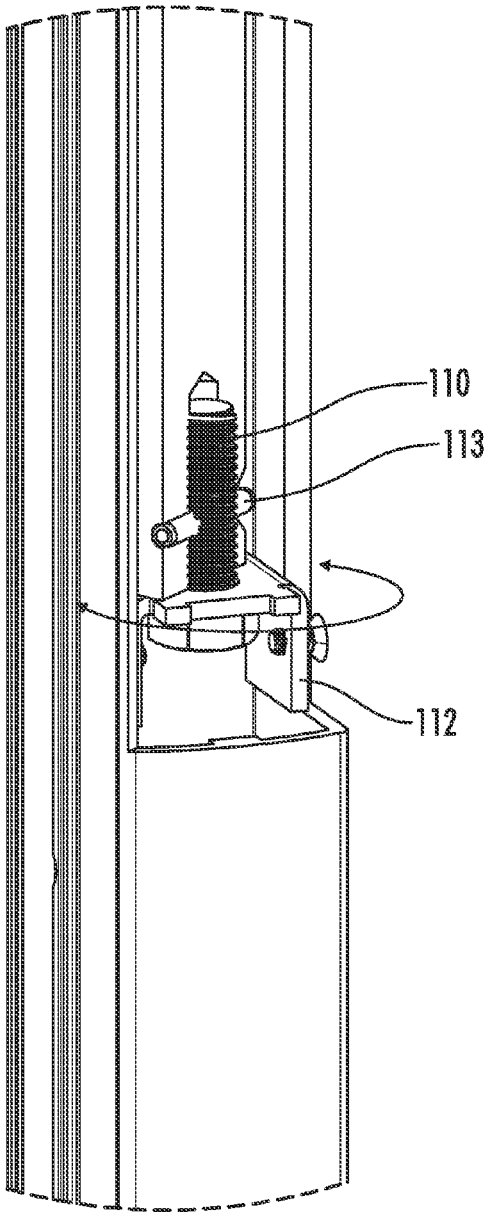
FIG. 24A illustrates a side, perspective, close-up view of the circled area labelled 24A in FIG. 24.
Figure 25:
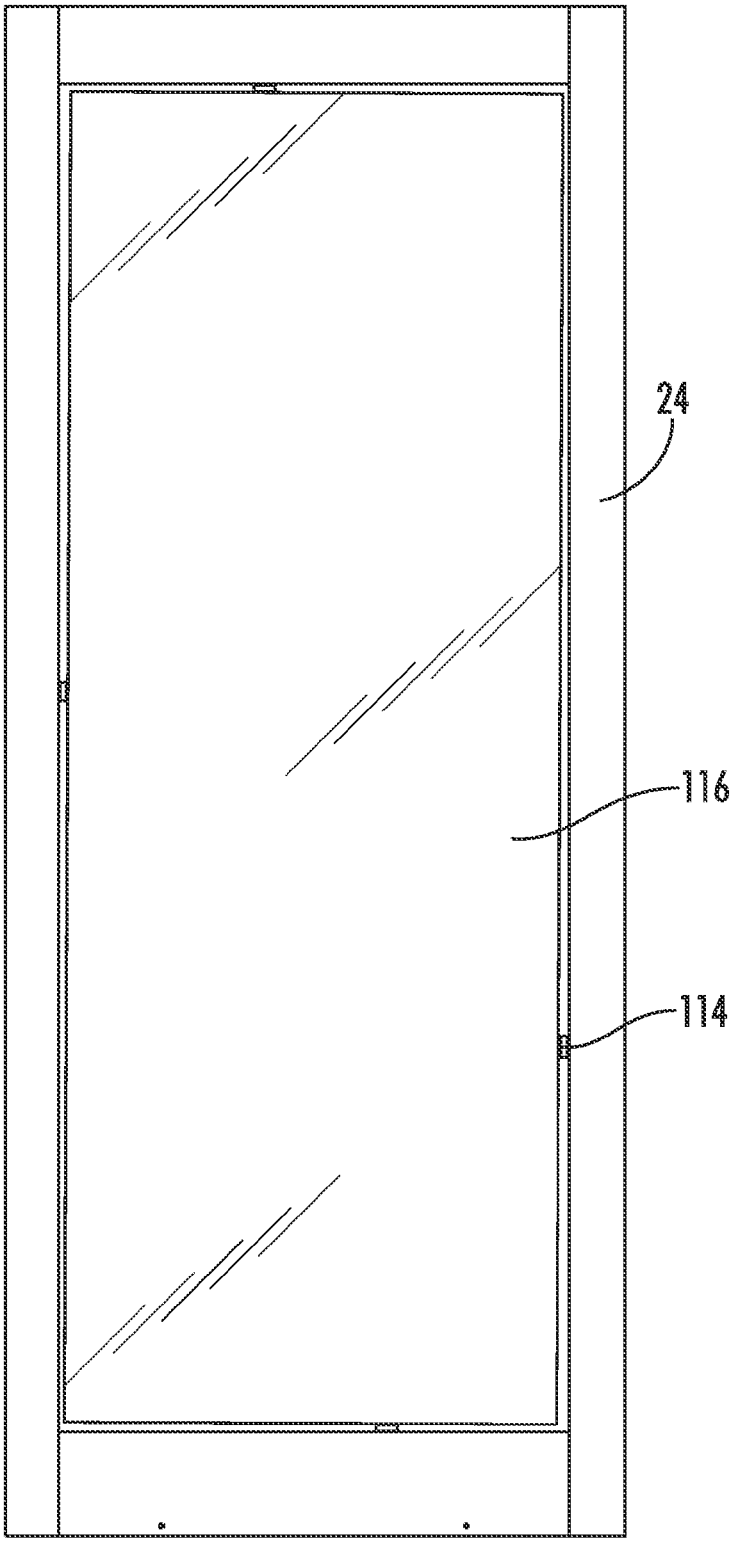
FIG. 25 illustrates a schematic view of a left door of another embodiment of the present invention that includes a plurality of glazing blocks and a glazing panel.
Figure 26:
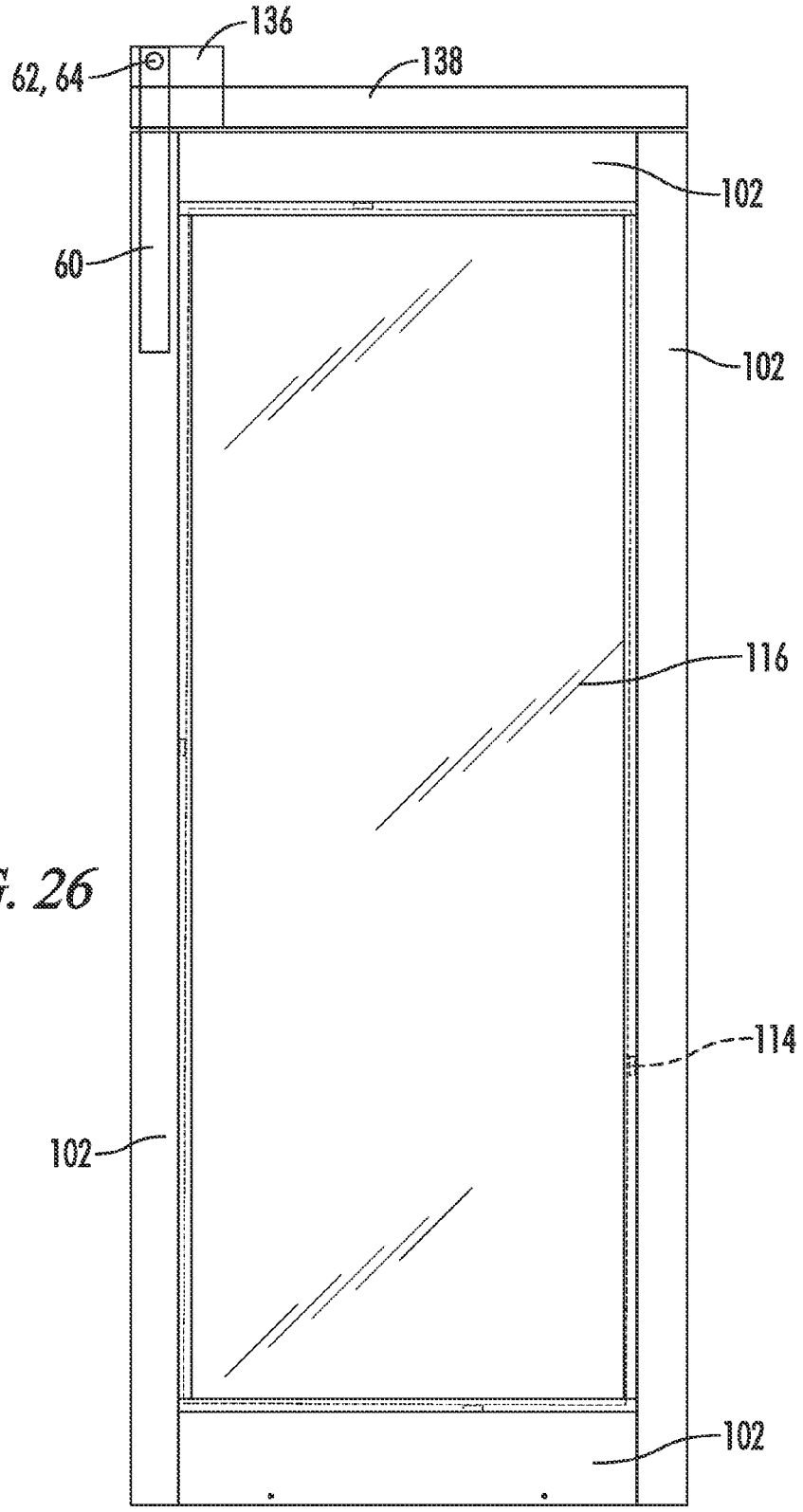
FIG. 26 illustrates a schematic view of the left door of FIG. 25 with the front of a portion of the top left panel and the left door frame removed to show the left rod.

Optionally, the left door 24 is configured to pivot (e.g., rotate) about the left rod 60 from the sliding plane to a left door front open position (as illustrated in FIGS. 5, 13 and 24) and to a left door rear open position (as illustrated in FIGS. 4 and 14) when a force is exerted on the left door perpendicular to the left door front side 26 and left door rear side 28 (i.e. pushing on the front side 26 or rear side 28), when the left door 24 is in the sliding plane. Optionally, the left door right side 34 is in front of the rectangular door system frame 12 and in front of the left door left side 32 in the left door front open position (as illustrated in FIGS. 5, 13 and 24) and the left door right, side 34 is to the rear of the rectangular door system frame 12 and to the rear of the left door left side 32 in the left door rear open position (as illustrated in FIGS. 4 and 14). Optionally, when the left door 24 is in the left door front open position, the left door width 36 is approximately 60-90 degrees, preferably approximately 90 degrees (i.e., perpendicular) relative to the system frame width. 22 and when the left door 24 is in the left door rear open position, the left door width 36 is approximately 60-90 degrees, preferably approximately 90 degrees (i.e., perpendicular) relative to the system frame width 22.

Optionally, the right door 130 is configured to pivot similarly.

Optionally, the bottom 40 of the left door right side 34 is configured to remain at substantially the same height (and level relative to the ground and the top left panel 44) when the left door 24 pivots about the left rod 60 from the sliding plane to the left door front open position and to the left door rear open position and the right door 130 is similarly configured to remain level. Thus, the left door 24 breaks open in two directions while remaining level relative to the top left panel 44 and the ground. (As explained in the Background, the prior art systems are primarily designed to break open in one direction—not two—and the prior art systems typically allow the nose of the door (the bottom of the left door right side) to touch the ground when breaking open).

Figure 9A:
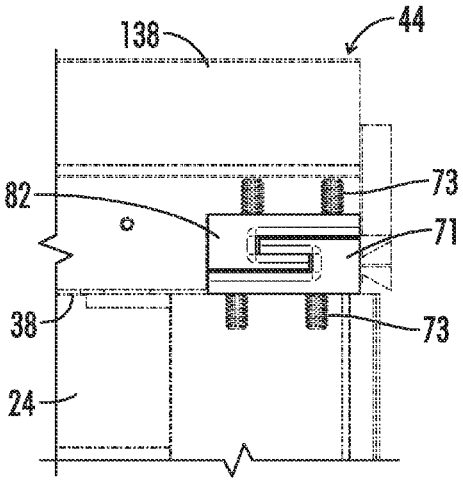
FIG. 9A illustrates a rear, elevation close-up view of the left door top and the top left panel bottom of FIG. 1; the top left panel and the left door are partially transparent in order to show the latch fasteners attaching the top left panel bottom latch to the top left panel and the left door top latch to the left door.
Figure 9B:
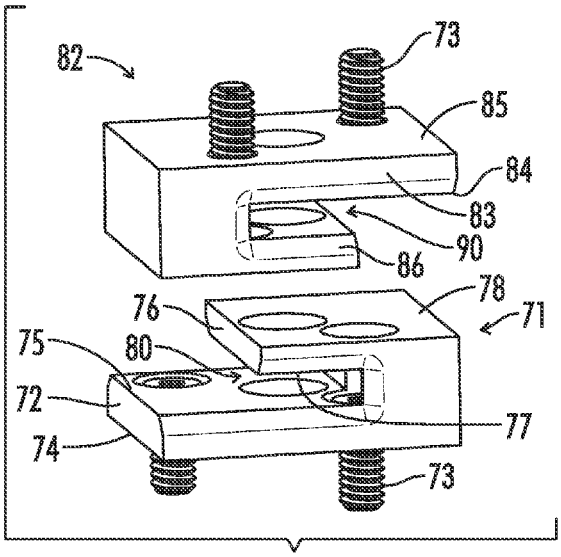
FIG. 9B illustrates a rear, exploded view of the latch fasteners, and top left panel bottom latch and left door top latch of FIG. 9A.
Figure 9C:
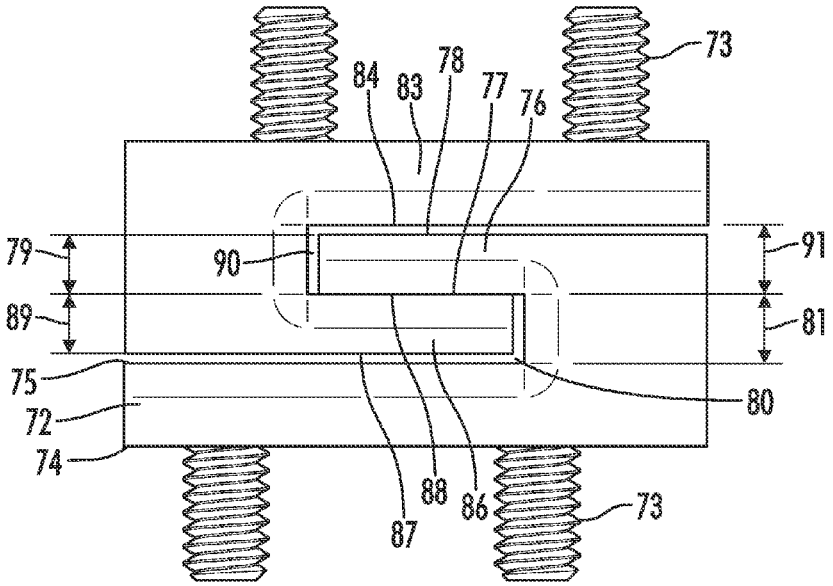
FIG. 9C illustrates a rear, elevation close-up view of the latch fasteners, and top left panel bottom latch and left door top latch of FIG. 9A; MG. 9C shows how the top left panel bottom latch and the left door top latch mate when the left door is in the sliding plane.
Figure 10:
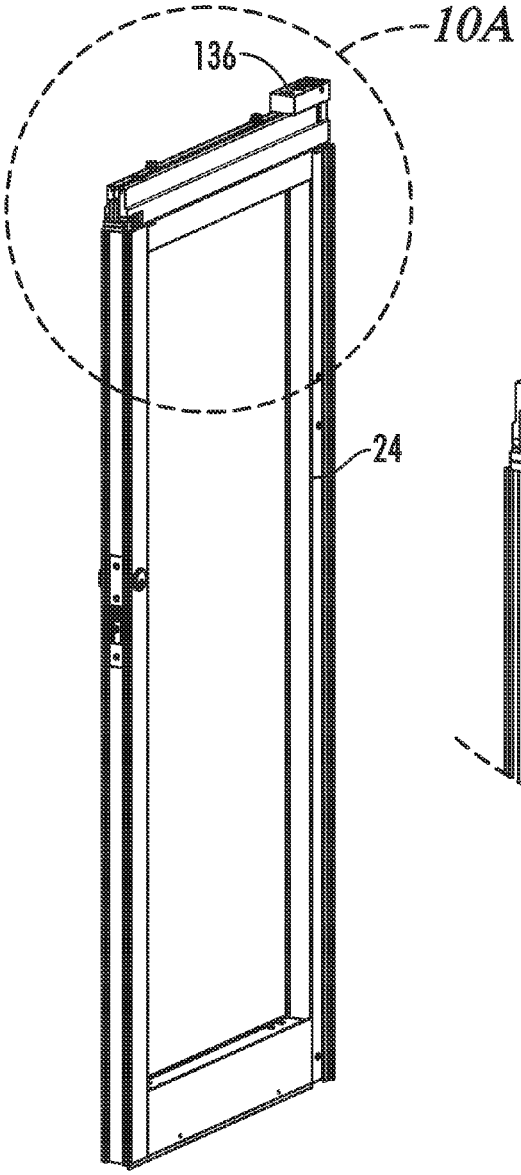
FIG. 10 illustrates a front, perspective view of the left door and the top left panel of the double breakout sliding door system of FIG. 1.
Figure 10A:
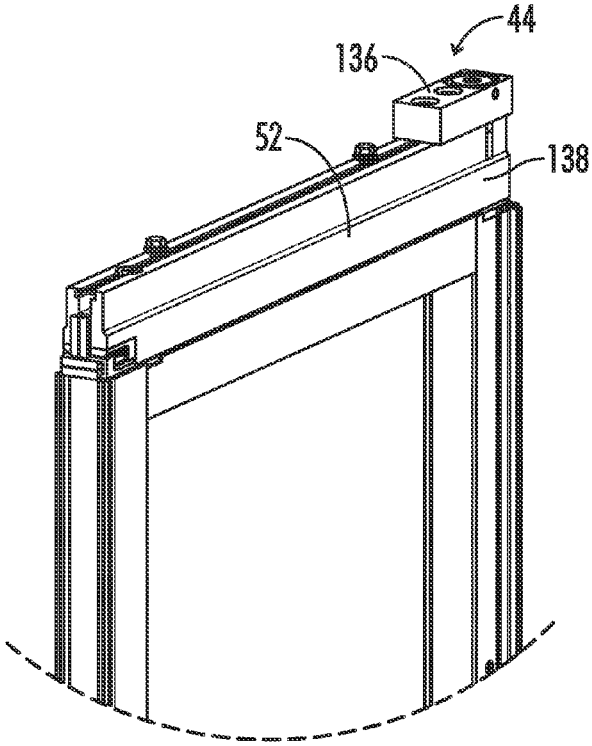
FIG. 10A illustrates a front, perspective close-up view of the circled area labelled 10A in FIG. 10.
Figure 11:
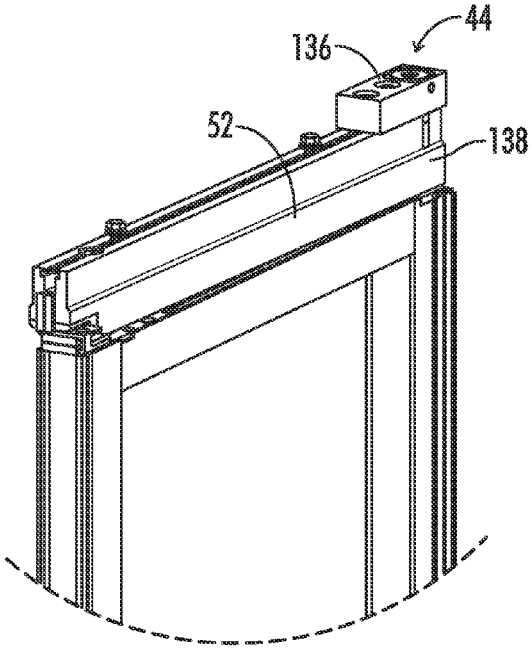
FIG. 11 illustrates a front, perspective view of the left door and top left panel of the double breakout sliding door system of FIG. 1.
Figure 12:
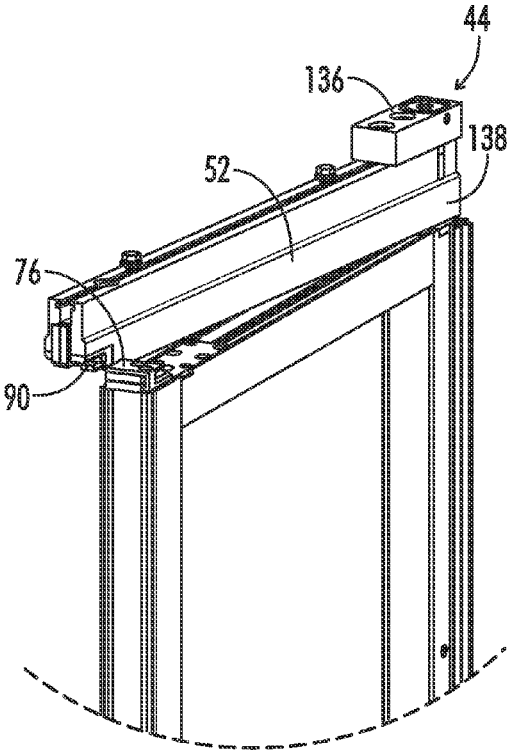
FIG. 12 illustrates a front, perspective view of the left door and top left panel of the double breakout sliding door system of FIG. 1.

Optionally, the left door 24 and top left panel 44 interlock through the use of mating latches 71 and 82 when the left door 24 is in the sliding plane. This interlocking latch feature in addition to the left rod 60 supports the left door 24 when the left door 24 is in the sliding plane). More particularly, in some embodiments, the left door 24 further comprises a left door top latch 71 attached to the left door 24 via latch fasteners 73. The left door top latch 71 is adjacent (i.e., at or near) the left door right side 20 and the left door top latch 71 has a left door latch base 72 that has a left door latch base bottom 74 attached to the left door top 38 and a left door latch base top 75. The left door top latch 71 further includes a left door latch flange 76 that is located above the left door latch base 72 and includes a left door latch flange bottom 77, a left door latch flange top 78 and a left door latch flange height 79 extending from the left door latch flange bottom 77 to the left door latch flange top 78. The left door top latch 71 further includes a left door latch slot 80 that is located between the left door latch base 72 and the left door latch flange 76 and that has a left door latch slot height 81 extending from the left door latch base top 75 to the left door latch flange bottom 77. In such embodiments, the top left panel 44 further comprises a top left panel bottom, latch 82 attached to the top left panel 44 via latch fasteners 73. The top left panel bottom latch 82 is adjacent (i.e., at or near) the top left panel right side 47 and the top left panel bottom latch 82 has a top left panel latch base 83 that has a top left panel latch base top 85 attached to the top left panel bottom 48 and a top left panel latch base bottom 84. The top left panel bottom, latch 82 further includes a top left panel latch flange 86 that is located below the top left panel latch base 83 and includes a top left panel latch flange bottom 87, a top left panel latch flange top 88 and a top left panel latch flange height 89 extending from the top left panel latch flange bottom 87 to the top left panel latch flange top 88. The top left panel bottom latch 82 further includes a top left panel latch slot 90 that is located between the top left panel latch base 83 and the top left panel latch flange 86 and that has a top left panel latch slot height 91 extending from the top left panel latch base bottom 84 to the top left panel latch flange top 88. The top left panel bottom latch 82 may be located in a cut-out of the top left panel 44, as best seen in FIGS. 9A, 10, 10A, and 11-16. The top left panel latch slot height 91 is slightly greater than the left door latch flange height 79, which allows the left door latch flange 76 to nest inside the top left panel latch slot 90 when the left door 24 is in the sliding plane, as best seen in FIG. 9C. Similarly, the left door latch slot height 81 is slightly greater than the top left panel latch flange height 89, which allows the top left panel latch flange 86 to nest inside the left door latch slot 80 when the left door 24 is in the sliding plane, as best seen in FIG. 9C, which in turn allows the top left panel 44 to support the left door 24 when the left door 24 is in the sliding plane, as best seen in FIGS. 10, 10A, 15, and 29. Optionally the left door latch slot 80 and top left panel latch slot 90 are generally U-shaped, best seen in FIGS. 9A, 9B, and 9C. The top left panel latch slot 90 extends from the top left panel front side 52 to the top left panel rear side 54, which allows the left door latch flange 76 to pass through when the left door 24 moves from the sliding plane (in which the left door 24 is supported by the top left panel bottom latch 82) to the left door front open position and the left door rear open position. Similarly, the left door latch slot 80 extends from the left door front side 26 to the left door rear side 28, which allows the top left panel latch flange 86 to pass through when the left door 24 moves from the sliding plane to the left door rear open position and the left door front open position. The user is able to align the top left panel bottom latch 82 with the left door top latch 71 using the left adjustment fastener 100, which, as explained below, causes the left rod 60 to pivot, about the left pivot pin 62 and left pivot pin axis 64. (Again, the right door 130 and top right panel 134 may include similar interlocking features).

The double breakout sliding door system 10 optionally further includes a ball detent mechanism to alert the user that the latches 71 and 82 are properly aligned—i.e., the left door latch flange 76 is nested in the top left panel latch slot 90 and the top left panel latch flange 86 is nested in the left door latch slot 80. For example, the left door 24 and the top left panel 44 may include a ball detent comprising a ball 94, a recess 96 configured to receive the ball 94, and a spring 98 connected to the ball 94 and configured to urge the ball 94 toward the recess 96, and the ball 94 is configured to move into the recess 96 when the top left panel latch flange 86 is nested in the left door latch slat 80 and the left door latch flange 76 is nested in the top left panel latch slot 90.

Figure 27:
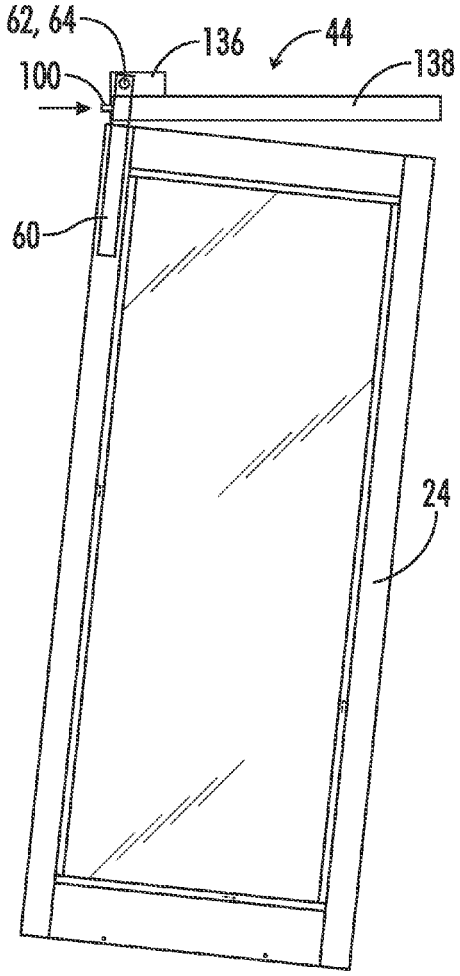
FIG. 27 illustrates a schematic view of the left door of FIG. 25 and illustrates how the left rod is configured to raise and lower the left door.
Figure 28:
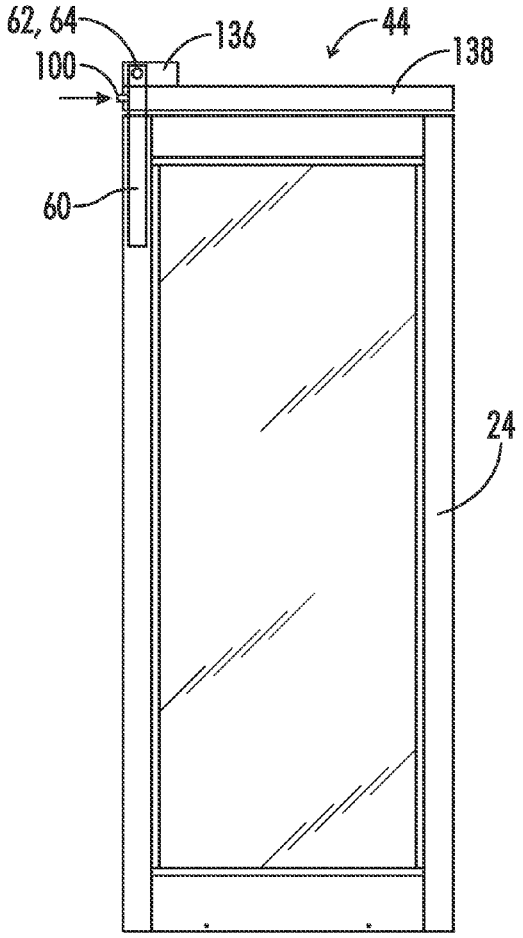
FIG. 28 illustrates a schematic view of the left door of FIG. 25 in which the left adjustment fastener has been used to level the left door relative to the top left panel and the ground.
Figure 29:
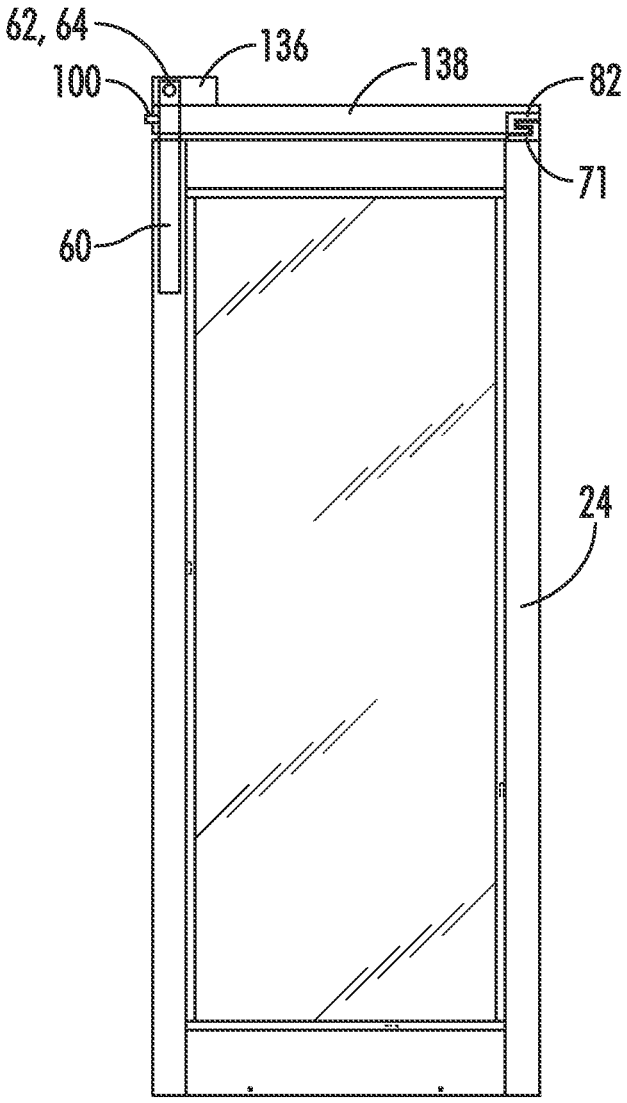
FIG. 29 illustrates a schematic view of the left door of FIG. 25 in which the left door is held up via the left rod as well as the left door latch flange positioned in the top left panel latch slot.

Optionally, the left rod bottom 60 is configured to be the sole point of attachment of the left door 24 to the top left panel 44 when the left door 24 is in the left door front open position and the left door rear open position, as best seen in FIG. 27.

Optionally, the left pivot pin axis 64 is perpendicular to the system frame front side 7 and system frame rear side 8.

Figure 16:
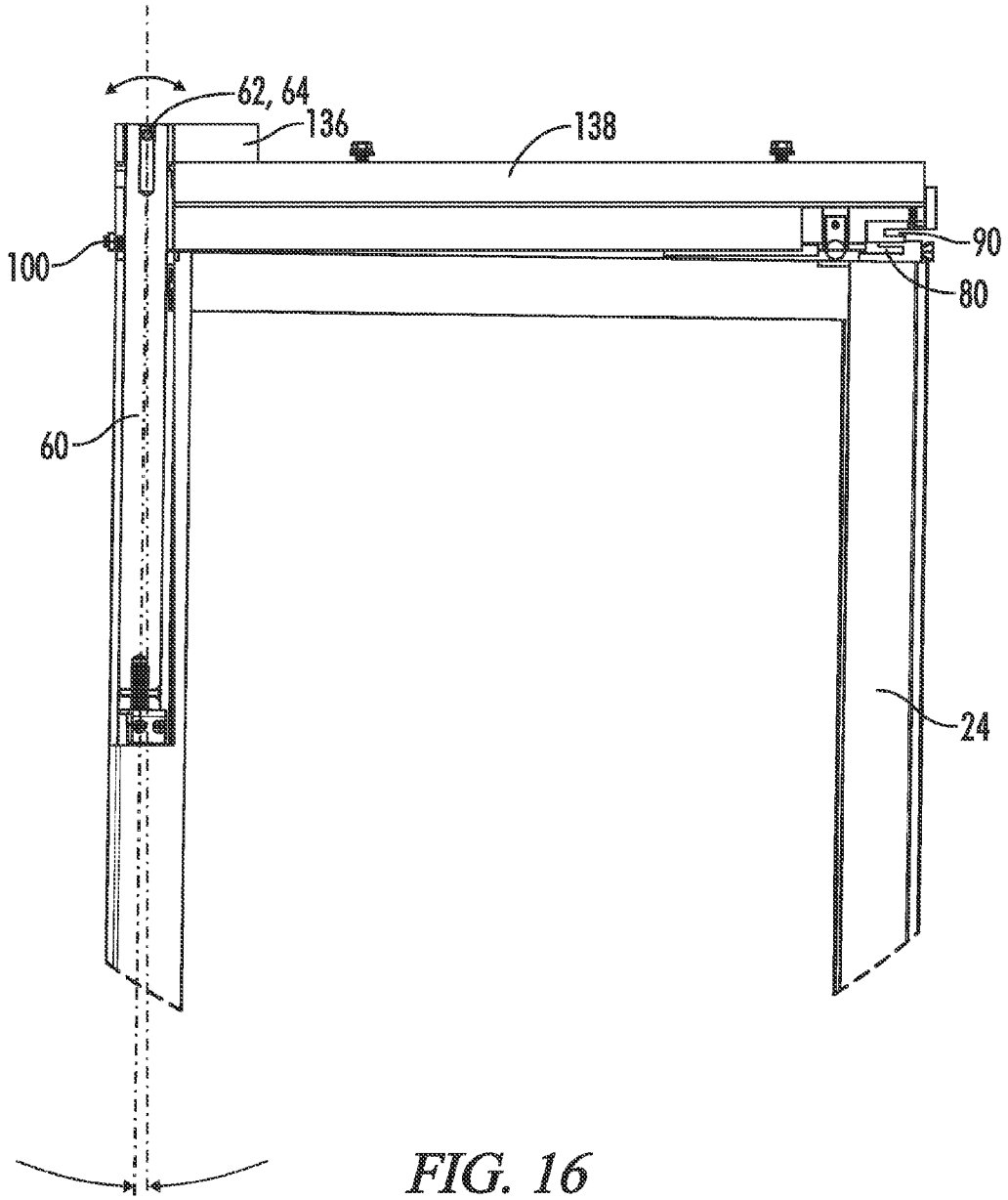
FIG. 16 illustrates a rear, elevation view of the left door and the top left panel of the double breakout sliding door system of FIG. 1.
Figure 17:
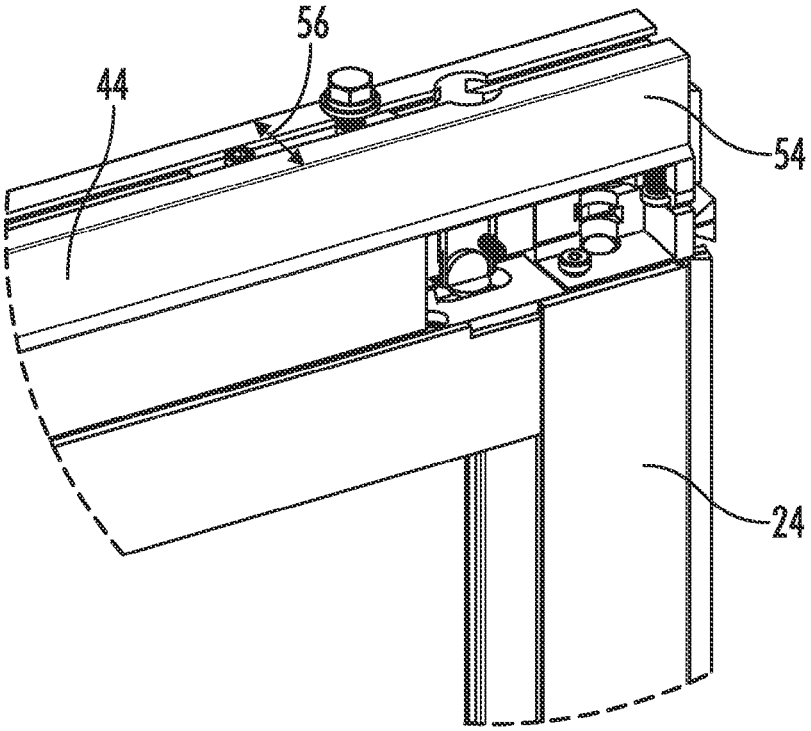
FIG. 17 illustrates a rear, perspective view of the left door and the top left panel of the double breakout sliding door system of FIG. 1.
Figure 18:
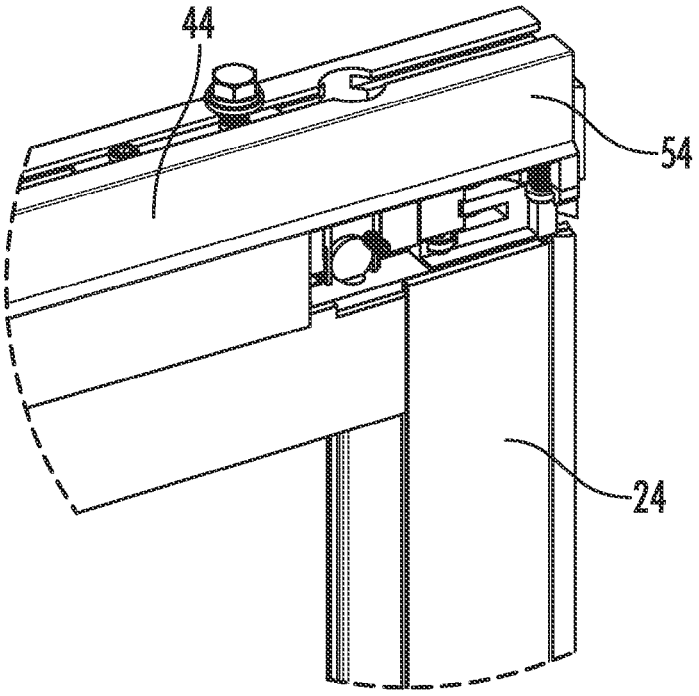
FIG. 18 illustrates a rear, perspective view of the left door and the top left panel of the double breakout sliding door system of FIG. 1.
Figure 19:
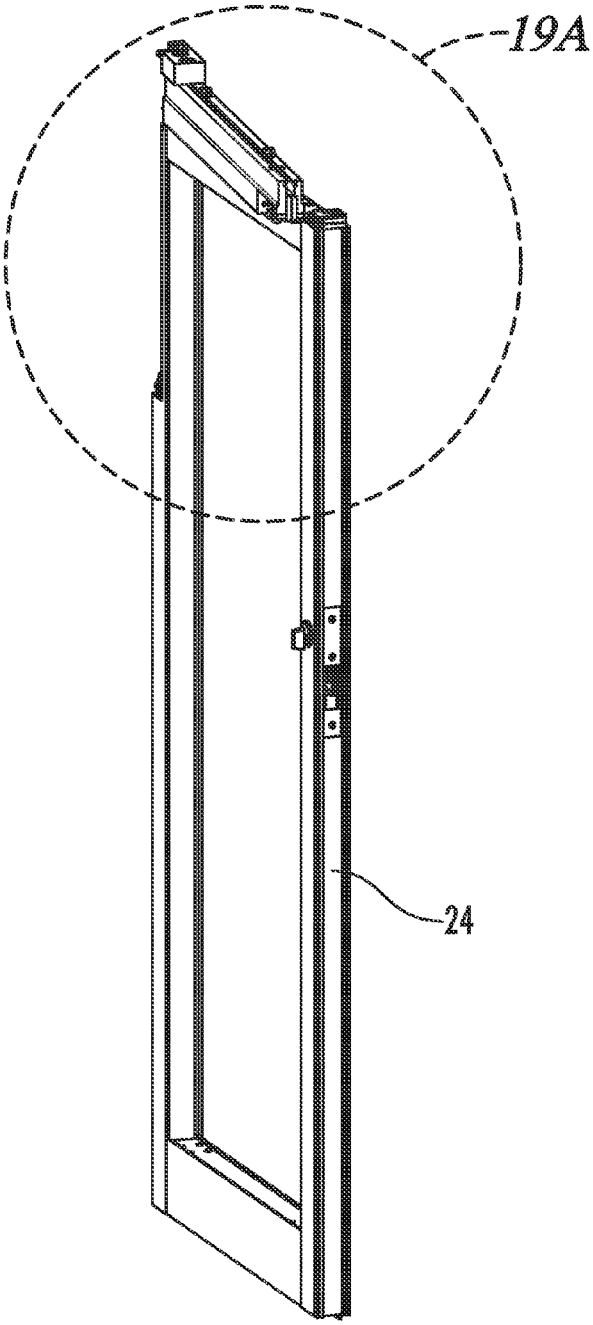
FIG. 19 illustrates a side, perspective view of the left door and the top left panel of the double breakout, sliding door system of FIG. 1.
Figure 19A:
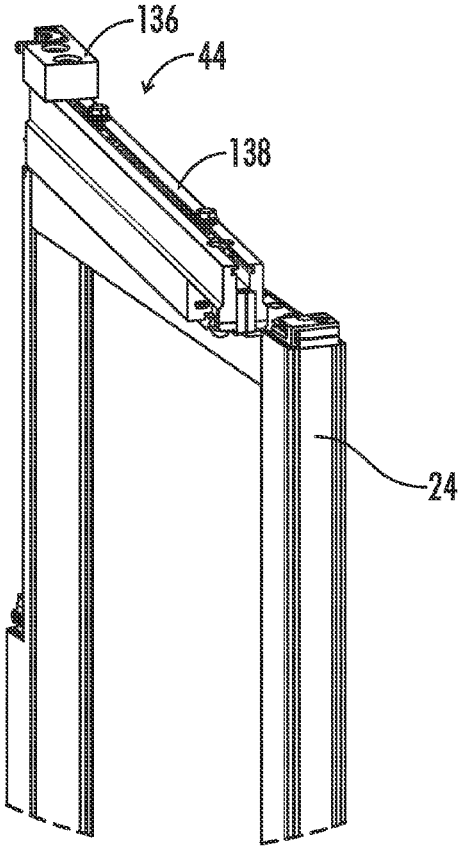
FIG. 19A illustrates a side, perspective, close-up view of the circled area labelled. 19A in FIG. 19.

Optionally, the top left panel 44 further comprises a left adjustment fastener 100 configured to engage the left rod 60 and cause the left rod 60 to pivot along the left pivot pin axis 64, as best seen in FIGS. 16 and 27. The left adjustment fastener 100 may be, for example, a jack screw (e.g., a set screw). The left adjustment fastener 100 is preferably located on the left side of top left panel 44. Again, the top right panel 134 may include a similar adjustment fastener. Pivoting of the left rod 60 along the left pivot pin axis 64 is configured to cause the bottom 40 of the left door right side 34 to move vertically (i.e., up or down) relative to the top left panel 44 and the ground, which allows the user to adjust the distance from the bottom 40 of the left door right side 34 to the ground so that the bottom 40 of the left door right side 34 does not drop (relative to the ground and rectangular door system frame 12) when the left door 24 moves from the sliding plane to the left door front open position and the left door rear open position. It will be appreciated that when the bottom 40 of the left door right side 34 moves vertically, it may also move horizontally, which is apparent from FIG. 16.

Optionally, the left door 24 comprises a frame 102 and a transparent or semi-transparent material (e.g., glass or plastic)—i.e., a window. The left door frame 102 may include a left door frame interior 104 and the left rod 60 may be located within the left door frame interior 104. Again, the right door 130 may have similar features. Optionally, the bottom 68 of the left rod 60 is hollow and surrounds a threaded shank 110 of a left threaded bolt 106 that includes a head 108 and the threaded shank 110, wherein the left rod 60 is fixed to the threaded shank 110 of the left threaded bolt. 106, wherein the left door 24 further comprises a left door bracket 112 located between the head 108 of the left threaded bolt 106 and the left rod bottom 68, wherein the left door bracket 112 is attached to the left door frame 102, wherein the left door bracket 112 is configured to rotate about the left rod 60 and the left threaded bolt 106 while the left rod 60 and the left threaded bolt 106 remain stationary as the left door 24 moves from the sliding plane to the left door front open position and the left door rear open position. Again, the right door 130 can include similar features. Bolts can be any suitable material, including for example, metal or nylon. The double breakout sliding door system 10 optionally further includes a left fastener 113 fixing the left rod 60 to the threaded shank 110 of the left threaded bolt 106. A right fastener may also be included for the right door 130. Optionally, the left door frame 102 forms a perimeter around a plurality of left door glazing blocks 114 (e.g., glass blocks) and the plurality of left door glazing blocks 114 are located between the left door frame 102 and a left door glazing panel 116, as shown in FIGS. 25-29. The purpose of the glazing blocks 114 is that the left door frame 102 may be comprised of aluminum and the glazing blocks 114 give structural integrity to the left door 24 so that the left door 24 moves when turning the left adjustment fastener 100. Again, the right door 130 may include similar features. In other embodiments, the left door 24 may not include left door glazing blocks 114 or left door glazing panel 116, and instead may be solely comprised of non-transparent/non-semi-transparent material—e.g., metal.

The double breakout sliding door system 10 optionally further includes a door lock 126 comprising a bar extending from the left door 24 to the right door 130 and configured to fix the left door 24 relative to the light door 130. Optionally, the system 10 further includes at least one top lock 128 comprising a bar extending from the top of a door 24 or 130 to the bottom of a top panel 44 or 134 and configured to fix the door 24 or 130 relative to the top panel 44 or 134.

The double breakout sliding door system 10 optionally includes a left track 120 located above the top left panel 44 and a left wheel 122 connected to the top left panel 44 and located in the left track 120 and the left wheel 122 is configured to move along the left track 120 when the top left panel 44 and the left door 24 slide from the sliding closed position to the sliding open position. The right door 130 may include similar features. Optionally, the motor 58 is configured to move the left wheel 122 along the left track 120. It will be appreciated that references herein to the singular embrace the plural. Thus, the double breakout sliding door system 10 may include one or more left wheels 122.

The double breakout sliding door system 10 optionally further includes one or more motion sensors 124 (preferably two motion sensors that are adjacent to the system frame front and rear sides 7 and 8) in electronic communication with the motor 58 and configured to cause the left door 24 and the top left panel 44, the right door 130 and the top right panel 134 to move from the sliding closed position to the sliding open position when the sensor 124 detects an object, such as a human or shopping cart, in front of or to the rear of the left door 24 and the right door 130.

The double breakout sliding door system 10 optionally further includes a left door panel 118 configured to remain fixed relative to the rectangular door system frame 12 when the left door 24 moves from the sliding closed position to the sliding open position, the left door panel 118 located to the left of the left door 24 when the left door 24 is in the sliding closed position. In such a case, the left door 24 is configured to slide to the rear of the left door panel 118 when the left door 24 slides from the sliding closed position to the sliding open position, the left door panel 118 is configured to move with the left door 24 when the left door 24 moves from the sliding plane to the left door front open position, and the left door panel 118 is configured to remain fixed relative to the rectangular door system frame 12 when the left door 24 moves from the sliding plane to the left door rear open position. A right door panel 134 having similar features may also be included.

Although the left door 24 and right door 130 may include a door lock 126 and top lock 128, there may be no similar locking system on the left door panel 118. Thus, the double breakout sliding door system 10 optionally further includes a left door panel interlocking device located on the rear 28 of the left door 24 which hooks into the left door panel 118 thereby preventing the left door panel 118 from being opened when the left door 24 is in the sliding closed position, regardless of whether the door lock 126 and top lock 128 are engaged. If one was to attempt to move the left door 24 from the sliding closed position to the rear open position, the left door panel interlocking device would actually hind up inside the left door panel 118 preventing the left door 24 from fully moving to the rear open position. So, there is a timing issue at stake here. In order for the left door 24 to move to the rear open position in embodiments with a left door panel interlocking device, the left door 24 must not be in the sliding closed position (i.e., the left door 24 must be in the sliding plane at either the sliding open position or between the sliding closed position and the sliding open position) to disengage the hook of the left door panel interlocking device (open at least one inch for example). Because this is an automatic door with a motion sensor 124, the motion sensor 124 will have detected any person or other object (and have caused the left wheel 122 and motor 58 to move the left door 24 in the sliding plane to either the sliding open position or between the sliding closed position and the sliding open position) before the object can get close enough to the left door 24 to touch it. Therefore, the left door 24 will always be at least slightly slid open (i.e., between the sliding open position and the sliding closed position) by the time a force is exerted on the left door 24 perpendicular to the left door front side 26 and left door rear side 28. As a result, the left door panel interlocking device does not impede the left door 24 from moving to the left door rear open position when the motor 58, motion sensor 124 and left wheel 122 are working correctly.

Optionally, moving the left door 24 from the sliding plane to the left door front open position and the left door rear open position is configured to disable the motor 58, as a safety feature. (Again, the same may be true with the right door 130 as it moves from the sliding plane to the right door front open position and the right door rear open position). To disable the motor 58, the double breakout sliding door system 10 may include a rear breakout sensor 142 that detects presence and is triggered when the left door 24 moves to the rear open position to disable the motor 58. (In some embodiments, the rear breakout sensor 142 is an infrared sensor that includes a transmitter that transmits the infrared beam and a receiver that receives the infrared beam, similar to the infrared setup used on a garage door. When the receiver no longer receives the beam, it knows that the left door 24 is in the left door rear open position and disables the motor 58). Similarly, to disable the motor 58 when the left door 24 moves to the left door front open position, there may be a front breakout sensor 144 located in the left door panel 118 that detects when the left door 24 moves to the left door front open position.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A double breakout sliding door system comprising:

a) a rectangular door system frame comprising a system frame front side, a system frame rear side, a system frame thickness extending from the system frame front side to the system frame rear side, a system frame top, a system frame bottom, a system frame height extending from the system frame top to the system frame bottom, a system frame left side, a system frame right side, and a system frame width extending from the system frame left side to the system frame right side, the rectangular door system frame defining a system frame opening;

b) a left door comprising a left door front side, a left door rear side, a left door thickness extending from the left door front side to the left door rear side, a left door left side, a left door right side, a left door width extending from the left door left side to the left door right side, the left door width perpendicular to the left door thickness, a left door top, a left door bottom, and a left door height extending from the left door top to the left door bottom, the left door height perpendicular to the left door width and the left door thickness;

c) a right door comprising a right door front side, a right door rear side, a right door thickness extending from the right door front side to the right door rear side, a right door left side, a right door right side, a right door width extending from the right door left side to the right door right side, the right door width perpendicular to the right door thickness, a right door top, a right door bottom, and a right door height extending from the right door top to the right door bottom, the right door height perpendicular to the right door width and the right door thickness;

d) a top left panel located above the left door, the top left panel connected to the left door and comprising a top left panel left side, a top left panel right side, a top left panel top, a top left panel bottom located below the system frame top, a top left panel height extending from the top left panel top to the top left panel bottom, a top left panel front side, a top left panel rear side, and a top left panel thickness extending from the top left panel front side to the top left panel rear side, the top left panel height perpendicular to the left door thickness, the top left panel thickness and the top left panel width;

e) a top right panel located above the right door, the top right panel connected to the right door and comprising a top right panel left side, a top right panel right side, a top right panel width extending from the top right panel left side to the top right panel right side, a top right panel top, a top right panel bottom located below the system frame top, a top right panel height extending from the top right panel top to the top right panel bottom, a top right panel front side, a top right panel rear side, and a top right panel thickness extending from the top right panel front side to the top right panel rear side, the top right panel height perpendicular to the right door thickness, the top right panel thickness and the top right panel width;

f) a motor;

g) a left rod having a left rod top pivotally attached to the top left panel by a left pivot pin forming a left pivot pin axis, a left rod bottom attached to the left door left side, and a left rod longitudinal axis extending from the left rod top to the left rod bottom, the left rod extending in a general downward direction from the top left panel at least partially through the left door, the left pivot pin transverse to the left rod longitudinal axis and attached to the top left panel; and h) a right rod having a right rod top pivotally attached to the top right panel by a right pivot pin forming a right pivot pin axis, a right rod bottom attached to the right door right side, and a right rod longitudinal axis extending from the right rod top to the right rod bottom, the right rod extending in a general downward direction from the top right panel at least partially through the right door, the right pivot pin transverse to the right rod longitudinal axis and attached to the top right panel, wherein the motor is configured to slide the left door and right door in a sliding plane parallel to the system frame width from a sliding open position in which the left and right doors are apart and do not close the system frame opening to a sliding closed position in which the left and right doors meet to close the system frame opening, wherein the top left panel is configured to slide with the left door from the sliding open position to the sliding closed position, wherein the top right panel is configured to slide with the right door from the sliding open position to the sliding closed position, wherein, when the left door moves from the sliding plane to a left door front open position when a force is exerted on the left door rear side perpendicular to the left door rear side when the left door is in the sliding plane, i) the left door is configured to rotate around the left rod about a left rotational plane generally perpendicular to the left rod longitudinal axis, ii) the left door is configured to rotate relative to the top left panel and iii) the left rod is configured to remain stationary relative to the top left panel, wherein, when the left door moves from the sliding plane to a left door rear open position when a force is exerted on the left door front side perpendicular to the left door front side when the left door is in the sliding plane, i) the left door is configured to rotate around the left rod about the left rotational plane, ii) the left door is configured to rotate relative to the top left panel and iii) the left rod is configured to remain stationary relative to the top left panel, wherein the left door right side is in front of the rectangular door system frame and in front of the left door left side in the left door front open position and wherein the left door right side is to the rear of the rectangular door system frame and to the rear of the left door left side in the left door rear open position, and further wherein, when the right door moves from the sliding plane to a right door front open position when a force is exerted on the right door rear side perpendicular to the right door rear side when the right door is in the sliding plane, i) the right door is configured to rotate around the right rod about a right rotational plane generally perpendicular to the right rod longitudinal axis, ii) the right door is configured to rotate relative to the top right panel and iii) the right rod is configured to remain stationary relative to the top right panel, wherein, when the right door moves from the sliding plane to a right door rear open position when a force is exerted on the right door front side perpendicular to the right door front side when the right door is in the sliding plane, i) the right door is configured to rotate around the right rod about the right rotational plane, ii) the right door is configured to rotate relative to the top right panel and iii) the right rod is configured to remain stationary relative to the top right panel, wherein the right door left side is in front of the rectangular door system frame and in front of the right door right side in the right door front open position and wherein the right door left side is to the rear of the rectangular door system frame and to the rear of the right door right side in the right door rear open position.

2. The double breakout sliding door system of claim 1 wherein the bottom of the left door right side is configured to remain at substantially the same height relative to the rectangular door system frame when the left door rotates around the left rod from the sliding plane to the left door front open position and to the left door rear open position and further wherein the bottom of the left side of the right door is configured to remain at substantially the same height relative to the rectangular door system frame when the right door rotates around the right rod from the sliding plane to the right door front open position and to the right door rear open position.

3. The double breakout sliding door system of claim 1 wherein the system further comprises a left door top latch extending from the left door top, wherein the system further comprises a top left panel bottom latch extending from the top left panel bottom, wherein the left door top latch and the top left panel bottom latch are configured to mate when the left door is in the sliding plane and further wherein the left door top latch and the top left panel bottom latch are not configured to mate when the left door is in the left door front open position and the left door rear open position.

4. The double breakout sliding door system of claim 3 wherein the top left panel bottom latch is configured to support the left door when the left door is in the sliding plane and further wherein the top left panel bottom latch is not configured to support the left door when the left door is in the left door front open position and the left door rear open position.

5. The double breakout sliding door system of claim 3 wherein the left door top latch is adjacent to the left door right side, wherein the left door top latch comprises:

i) a left door latch base comprising a left door latch base bottom attached to the left door top and a left door latch base top;

ii) a left door latch flange located above the left door latch base and comprising a left door latch flange bottom, a left door latch flange top and a left door latch flange height extending from the left door latch flange bottom to the left door latch flange top; and iii) a left door latch slot located between the left door latch base and the left door latch flange and comprising a left door latch slot height extending from the left door latch base top to the left door latch flange bottom, wherein the top left panel bottom latch is adjacent to the top left panel right side, wherein the top left panel bottom latch comprises:

i) a top left panel latch base comprising a top left panel latch base top attached to the top left panel bottom and a top left panel latch base bottom;

ii) a top left panel latch flange located below the top left panel latch base and comprising a top left panel latch flange bottom, a top left panel latch flange top and a top left panel latch flange height extending from the top left panel latch flange bottom to the top left panel latch flange top; and iii) a top left panel latch slot located between the top left panel latch base and the top left panel latch flange and comprising a top left panel latch slot height extending from the top left panel latch base bottom to the top left panel latch flange top, wherein the top left panel latch slot height is greater than the left door latch flange height, wherein the left door latch slot height is greater than the top left panel latch flange height, wherein the left door latch flange is configured to be positioned in the top left panel latch slot when the left door is in the sliding plane, and further wherein the top left panel latch flange is configured to be positioned in the left door latch slot when the left door is in the sliding plane.

6. The double breakout sliding door system of claim 5, wherein the left door and the top left panel further comprises a ball detent comprising a ball, a recess configured to receive the ball, and a spring connected to the ball and configured to urge the ball toward the recess, and further wherein the ball is configured to move into the recess when the top left panel latch flange is positioned in the left door latch slot and the left door latch flange is positioned in the top left panel latch slot.

7. The double breakout sliding door system of claim 1 wherein the left rod bottom is configured to be the sole point of attachment of the left door to the top left panel when the left door is in the left door front open position and the left door rear open position.

8. The double breakout sliding door system of claim 1 wherein the left pivot pin axis and the right pivot pin axis are perpendicular to the system frame front side and the system frame rear side.

9. The double breakout sliding door system of claim 1 wherein the top left panel further comprises a left adjustment fastener configured to engage the left rod and cause the left rod to move about the left pivot pin axis in a plane generally perpendicular to the left rotational plane and further wherein the top right panel further comprises a right adjustment fastener configured to engage the right rod and cause the right rod to move about the right pivot pin axis in a plane generally perpendicular to the right rotational plane.

10. The double breakout sliding door system of claim 9 wherein moving the left rod about the left pivot pin axis is configured to cause the bottom of the left door right side to move vertically relative to the top left panel and further wherein moving the right rod about the right pivot axis is configured to cause the bottom of the right door left side to move vertically relative to the top right panel.

11. The double breakout sliding door system of claim 1 wherein the left door comprises a left door frame comprising an interior and further wherein the left rod is located within the left door frame interior and further wherein the right door comprises a right door frame comprising an interior and further wherein the right rod is located within the right door frame interior.

12. The double breakout sliding door system of claim 11 wherein the left rod bottom is hollow and surrounds a threaded shank of a left threaded bolt comprising a head and the threaded shank, wherein the left rod is fixed to the threaded shank of the left threaded bolt, wherein the left door further comprises a left door bracket located between the head of the left threaded bolt and the left rod bottom, wherein the left door bracket is attached to the left door frame, wherein the left door bracket is configured to rotate about the left rod and the left threaded bolt while the left rod and the left threaded bolt remain stationary as the left door moves from the sliding plane to the left door front open position and the left door rear open position and further wherein the bottom of the right rod is hollow and surrounds a threaded shank of a right threaded bolt comprising a head and the threaded shank, wherein the right rod is fixed to the threaded shank of the right threaded bolt, wherein the right door further comprises a right door bracket located between the head of the right threaded bolt and the bottom of the right rod, wherein the right door bracket is attached to the left door frame, wherein the right door bracket is configured to rotate about the right rod and the right threaded bolt while the right rod and the right threaded bolt remain stationary as the right door moves from the sliding plane to the right door front open position and the right door rear open position.

13. The double breakout sliding door system of claim 12 further comprising a left fastener fixing the left rod to the threaded shank of the left threaded bolt and a right fastener fixing the right rod to the threaded shank of the right threaded bolt.

14. The double breakout sliding door system of claim 11 wherein the left door frame forms a perimeter around a plurality of left door glazing blocks and further wherein the right door frame forms a perimeter around a plurality of right door glazing blocks.

15. The double breakout sliding door system of claim 14 further wherein the plurality of left door glazing blocks are located between the left door frame and a left door glazing panel and further wherein the plurality of right door glazing blocks are located between the right door frame and a right door glazing panel.

16. The double breakout sliding door system of claim 1 further comprising a left door panel configured to remain fixed relative to the rectangular door system frame when the left door moves from the sliding closed position to the sliding open position, the left door panel located to the left of the left door when the left door is in the sliding closed position, wherein the left door is configured to slide to the rear of the left door panel when the left door slides from the sliding closed position to the sliding open position, wherein the left door panel is configured to move with the left door when the left door moves from the sliding plane to the left door front open position, and further wherein the left door panel is configured to remain fixed relative to the rectangular door system frame when the left door moves from the sliding plane to the left door rear open position.

17. The double breakout sliding door system of claim 1 further comprising a left track located above the top left panel and further wherein the system comprises a left wheel connected to the top left panel and located in the left track and further wherein the left wheel is configured to move along the left track when the top left panel and left door slide from the sliding closed position to the sliding open position and further wherein the system further comprises a right track located above the top right panel and further wherein the system comprises a right wheel connected to the top right panel and located in the right track and further wherein the right wheel is configured to move along the right track when the top right panel and right door slide from the sliding closed position to the sliding open position.

18. The double breakout sliding door system of claim 17 wherein the motor is configured to move the left wheel along the left track and the right wheel along the right track.

19. A double breakout sliding door system comprising:

a) a rectangular door system frame comprising a system frame front side, a system frame rear side, a system frame thickness extending from the system frame front side to the system frame rear side, a system frame top, a system frame bottom, a system frame height extending from the system frame top to the system frame bottom, a system frame left side, a system frame right side, and a system frame width extending from the system frame left side to the system frame right side, the rectangular door system frame defining a system frame opening;

b) a left door comprising a left door front side, a left door rear side, a left door thickness extending from the left door front side to the left door rear side, a left door left side, a left door right side, a left door width extending from the left door left side to the left door right side, the left door width perpendicular to the left door thickness, a left door top, a left door bottom, and a left door height extending from the left door top to the left door bottom, the left door height perpendicular to the left door width and the left door thickness;

c) a right door comprising a right door front side, a right door rear side, a right door thickness extending from the right door front side to the right door rear side, a right door left side, a right door right side, a right door width extending from the right door left side to the right door right side, the right door width perpendicular to the right door thickness, a right door top, a right door bottom, and a right door height extending from the right door top to the right door bottom, the right door height perpendicular to the right door width and the right door thickness;

d) a top left panel located above the left door, the top left panel connected to the left door and comprising a top left panel left side, a top left panel right side, a top left panel top, a top left panel bottom located below the system frame top, a top left panel height extending from the top left panel top to the top left panel bottom, a top left panel front side, a top left panel rear side, and a top left panel thickness extending from the top left panel front side to the top left panel rear side, the top left panel height perpendicular to the left door thickness, the top left panel thickness and the top left panel width;

e) a top right panel located above the right door, the top right panel connected to the right door and comprising a top right panel left side, a top right panel right side, a top right panel width extending from the top right panel left side to the top right panel right side, a top right panel top, a top right panel bottom located below the system frame top, a top right panel height extending from the top right panel top to the top right panel bottom, a top right panel front side, a top right panel rear side, and a top right panel thickness extending from the top right panel front side to the top right panel rear side, the top right panel height perpendicular to the right door thickness, the top right panel thickness and the top right panel width;

f) a motor;

g) a left rod having a left rod top pivotally attached to the top left panel by a left pivot pin forming a left pivot pin axis and a left rod bottom attached to the left door left side, the left rod extending in a general downward direction from the top left panel at least partially through the left door; and h) a right rod having a right rod top pivotally attached to the top right panel by a right pivot pin forming a right pivot pin axis and a right rod bottom attached to the right door right side, the right rod extending in a general downward direction from the top right panel at least partially through the right door, wherein the motor is configured to slide the left door and right door in a sliding plane parallel to the system frame width from a sliding open position in which the left and right doors are apart and do not close the system frame opening to a sliding closed position in which the left and right doors meet to close the system frame opening, wherein the top left panel is configured to slide with the left door from the sliding open position to the sliding closed position, wherein the top right panel is configured to slide with the right door from the sliding open position to the sliding closed position, wherein the left door is configured to rotate about the left rod from the sliding plane to a left door front open position when a force is exerted on the left door rear side perpendicular to the left door rear side when the left door is in the sliding plane, wherein the left door is configured to rotate about the left rod from the sliding plane to a left door rear open position when a force is exerted on the left door front side perpendicular to the left door front side when the left door is in the sliding plane, wherein the left door right side is in front of the rectangular door system frame and in front of the left door left side in the left door front open position and wherein the left door right side is to the rear of the rectangular door system frame and to the rear of the left door left side in the left door rear open position, and further wherein the right door is configured to rotate about the right rod from the sliding plane to a right door front open position when a force is exerted on the right door rear side perpendicular to the right door rear side when the right door is in the sliding plane, wherein the right door is configured to rotate about the right rod from the sliding plane to a right door rear open position when a force is exerted on the right door front side perpendicular to the right door front side when the right door is in the sliding plane, wherein the right door left side is in front of the rectangular door system frame and in front of the right door right side in the right door front open position and wherein the right door left side is to the rear of the rectangular door system frame and to the rear of the right door right side in the right door rear open position, wherein the system further comprises a left door top latch extending from the left door top, wherein the system further comprises a top left panel bottom latch extending from the top left panel bottom, wherein the left door top latch and the top left panel bottom latch are configured to mate when the left door is in the sliding plane and further wherein the left door top latch and the top left panel bottom latch are not configured to mate when the left door is in the left door front open position and the left door rear open position, wherein the left door top latch is adjacent to the left door right side, wherein the left door top latch comprises:

i) a left door latch base comprising a left door latch base bottom attached to the left door top and a left door latch base top;

ii) a left door latch flange located above the left door latch base and comprising a left door latch flange bottom, a left door latch flange top and a left door latch flange height extending from the left door latch flange bottom to the left door latch flange top; and iii) a left door latch slot located between the left door latch base and the left door latch flange and comprising a left door latch slot height extending from the left door latch base top to the left door latch flange bottom, wherein the top left panel bottom latch is adjacent to the top left panel right side, wherein the top left panel bottom latch comprises:

i) a top left panel latch base comprising a top left panel latch base top attached to the top left panel bottom and a top left panel latch base bottom;

ii) a top left panel latch flange located below the top left panel latch base and comprising a top left panel latch flange bottom, a top left panel latch flange top and a top left panel latch flange height extending from the top left panel latch flange bottom to the top left panel latch flange top; and iii) a top left panel latch slot located between the top left panel latch base and the top left panel latch flange and comprising a top left panel latch slot height extending from the top left panel latch base bottom to the top left panel latch flange top, wherein the top left panel latch slot height is greater than the left door latch flange height, wherein the left door latch slot height is greater than the top left panel latch flange height, wherein the left door latch flange is configured to be positioned in the top left panel latch slot when the left door is in the sliding plane, and further wherein the top left panel latch flange is configured to be positioned in the left door latch slot when the left door is in the sliding plane.

20. A double breakout sliding door system comprising:

a) a rectangular door system frame comprising a system frame front side, a system frame rear side, a system frame thickness extending from the system frame front side to the system frame rear side, a system frame top, a system frame bottom, a system frame height extending from the system frame top to the system frame bottom, a system frame left side, a system frame right side, and a system frame width extending from the system frame left side to the system frame right side, the rectangular door system frame defining a system frame opening;

b) a left door comprising a left door front side, a left door rear side, a left door thickness extending from the left door front side to the left door rear side, a left door left side, a left door right side, a left door width extending from the left door left side to the left door right side, the left door width perpendicular to the left door thickness, a left door top, a left door bottom, and a left door height extending from the left door top to the left door bottom, the left door height perpendicular to the left door width and the left door thickness;

c) a right door comprising a right door front side, a right door rear side, a right door thickness extending from the right door front side to the right door rear side, a right door left side, a right door right side, a right door width extending from the right door left side to the right door right side, the right door width perpendicular to the right door thickness, a right door top, a right door bottom, and a right door height extending from the right door top to the right door bottom, the right door height perpendicular to the right door width and the right door thickness;

d) a top left panel located above the left door, the top left panel connected to the left door and comprising a top left panel left side, a top left panel right side, a top left panel top, a top left panel bottom located below the system frame top, a top left panel height extending from the top left panel top to the top left panel bottom, a top left panel front side, a top left panel rear side, and a top left panel thickness extending from the top left panel front side to the top left panel rear side, the top left panel height perpendicular to the left door thickness, the top left panel thickness and the top left panel width;

e) a top right panel located above the right door, the top right panel connected to the right door and comprising a top right panel left side, a top right panel right side, a top right panel width extending from the top right panel left side to the top right panel right side, a top right panel top, a top right panel bottom located below the system frame top, a top right panel height extending from the top right panel top to the top right panel bottom, a top right panel front side, a top right panel rear side, and a top right panel thickness extending from the top right panel front side to the top right panel rear side, the top right panel height perpendicular to the right door thickness, the top right panel thickness and the top right panel width;

f) a motor;

g) a left rod having a left rod top pivotally attached to the top left panel by a left pivot pin forming a left pivot pin axis and a left rod bottom attached to the left door left side, the left rod extending in a general downward direction from the top left panel at least partially through the left door; and h) a right rod having a right rod top pivotally attached to the top right panel by a right pivot pin forming a right pivot pin axis and a right rod bottom attached to the right door right side, the right rod extending in a general downward direction from the top right panel at least partially through the right door, wherein the motor is configured to slide the left door and right door in a sliding plane parallel to the system frame width from a sliding open position in which the left and right doors are apart and do not close the system frame opening to a sliding closed position in which the left and right doors meet to close the system frame opening, wherein the top left panel is configured to slide with the left door from the sliding open position to the sliding closed position, wherein the top right panel is configured to slide with the right door from the sliding open position to the sliding closed position, wherein the left door is configured to rotate about the left rod from the sliding plane to a left door front open position when a force is exerted on the left door rear side perpendicular to the left door rear side when the left door is in the sliding plane, wherein the left door is configured to rotate about the left rod from the sliding plane to a left door rear open position when a force is exerted on the left door front side perpendicular to the left door front side when the left door is in the sliding plane, wherein the left door right side is in front of the rectangular door system frame and in front of the left door left side in the left door front open position and wherein the left door right side is to the rear of the rectangular door system frame and to the rear of the left door left side in the left door rear open position, and further wherein the right door is configured to rotate about the right rod from the sliding plane to a right door front open position when a force is exerted on the right door rear side perpendicular to the right door rear side when the right door is in the sliding plane, wherein the right door is configured to rotate about the right rod from the sliding plane to a right door rear open position when a force is exerted on the right door front side perpendicular to the right door front side when the right door is in the sliding plane, wherein the right door left side is in front of the rectangular door system frame and in front of the right door right side in the right door front open position and wherein the right door left side is to the rear of the rectangular door system frame and to the rear of the right door right side in the right door rear open position, wherein the top left panel further comprises a left adjustment fastener configured to engage the left rod and cause the left rod to pivot along the left pivot pin axis and further wherein the top right panel further comprises a right adjustment fastener configured to engage the right rod and cause the right rod to pivot along the right pivot pin axis, and further wherein pivoting of the left rod along the left pivot pin axis is configured to cause the bottom of the left door right side to move vertically relative to the top left panel and further wherein pivoting of the right rod along the right pivot axis is configured to cause the bottom of the right door left side to move vertically relative to the top right panel.

* * * * *